US006969316B2

(12) United States Patent
Jarvis et al.

(10) Patent No.: US 6,969,316 B2
(45) Date of Patent: Nov. 29, 2005

(54) METHOD OF PLAYING SINGLE OR MULTIPLE HAND TWENTY-ONE CARD GAME

(75) Inventors: Eugene Jarvis, Park Ridge, IL (US); Andrew Eloff, Evanston, IL (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/820,548

(22) Filed: Apr. 8, 2004

(65) Prior Publication Data

US 2004/0192425 A1 Sep. 30, 2004

Related U.S. Application Data

(63) Continuation of application No. 10/053,101, filed on Nov. 13, 2001, now Pat. No. 6,726,427.

(51) Int. Cl.[7] ..... A63F 9/24
(52) U.S. Cl. ..... 463/12; 273/292
(58) Field of Search ..... 463/12–13, 16, 463/292, 138.1, 139, 143 R; 273/292, 138.1, 273/139, 143 R

(56) References Cited

U.S. PATENT DOCUMENTS 1,527,929 A 2/1925 Simons
3,796,433 A 3/1974 Fraley et al.
4,743,022 A 5/1988 Wood
5,019,973 A 5/1991 Wilcox et al.
5,154,429 A * 10/1992 LeVasseur ..... 273/292
5,158,293 A 10/1992 Mullins
5,248,142 A 9/1993 Breeding
5,255,915 A 10/1993 Miller
5,257,789 A 11/1993 LeVasseur
5,280,915 A 1/1994 Groussman
5,288,082 A 2/1994 Marquez
5,324,041 A 6/1994 Boylan et al.
5,413,353 A 5/1995 Demarest et al.
5,570,885 A 11/1996 Ornstein
5,586,766 A 12/1996 Forte et al.
5,678,821 A 10/1997 Hedman
5,697,614 A 12/1997 Potter et al.
5,711,525 A 1/1998 Breeding
5,718,431 A 2/1998 Ornstein
5,732,950 A 3/1998 Moody
5,755,621 A 5/1998 Marks et al.
5,788,241 A 8/1998 Ung
5,788,574 A 8/1998 Ornstein et al.
5,799,946 A 9/1998 Groussman
5,823,873 A 10/1998 Moody
5,833,536 A 11/1998 Davids et al.

(Continued)

OTHER PUBLICATIONS

John Scarne, Scarnes' New Complete Guide to Gambling, Simon and Schuster, Copy right 1961, 1974, pp. 372-381.*

(Continued)

*Primary Examiner*—Jessica Harrison
*Assistant Examiner*—Alex F. R. P. Rada, II
(74) *Attorney, Agent, or Firm*—Bell, Boyd & Lloyd LLC

(57) ABSTRACT

A method of playing a Blackjack or Twenty-One game that will enable a player to play single or multiple hands and/or wagers against single or multiple dealer hands in a rapid and substantially automatic fashion. In addition, the player can pre-select the point value at which to "stand," "split," "double," "surrender," and/or "take insurance," when playing single or multiple hands. The pre-selected strategy can then be duplicated across all player hands being played. The player can also select to "auto-play" one or more hands according to a preset strategy.

62 Claims, 25 Drawing Sheets

U.S. PATENT DOCUMENTS 5,839,730 A 11/1998 Pike
5,851,148 A 12/1998 Brune et al.
5,911,418 A 6/1999 Adams
5,934,998 A 8/1999 Forte et al.
5,944,314 A 8/1999 Stavinsky
5,954,335 A * 9/1999 Moody ..... 273/292
5,967,894 A 10/1999 Kinoshita et al.
5,984,309 A 11/1999 Santin
5,988,643 A 11/1999 Awada
6,007,066 A 12/1999 Moody
6,068,552 A * 5/2000 Walker et al. ..... 463/21
6,089,977 A 7/2000 Bennett
6,098,985 A 8/2000 Moody
6,129,357 A 10/2000 Wichinsky
6,131,906 A 10/2000 Green
6,131,907 A 10/2000 Nucifora et al.
6,131,908 A 10/2000 Palmer
6,132,311 A 10/2000 Williams
6,135,453 A 10/2000 Srichayaporn
6,135,882 A 10/2000 Kadlic
6,135,883 A 10/2000 Hachquet
6,146,271 A 11/2000 Kadlic
6,149,157 A 11/2000 Suan
6,149,521 A 11/2000 Sanduski
6,155,568 A 12/2000 Franklin
6,159,095 A 12/2000 Frohm et al.
6,164,652 A 12/2000 Lauretta et al.
6,179,293 B1 1/2001 Hedman
6,203,428 B1 3/2001 Giobbi et al.
6,220,959 B1 4/2001 Holmes, Jr. et al.
6,220,960 B1 4/2001 Kryzhanovsky
6,224,055 B1 5/2001 Walker et al.
6,244,957 B1 6/2001 Walker et al.
6,248,016 B1 6/2001 Walker et al.
6,250,685 B1 6/2001 Walker et al.
6,283,855 B1 9/2001 Bingham
6,299,170 B1 10/2001 Yoseloff
6,311,978 B1 11/2001 Moody
6,342,007 B1 1/2002 Wood et al.
6,651,985 B2 * 11/2003 Sines et al. ..... 273/309
6,663,486 B2 * 12/2003 D'Aurora et al. ..... 463/12
6,726,427 B2 * 4/2004 Jarvis et al. ..... 273/292

OTHER PUBLICATIONS

Stanford Wong, Basic Blackjack, copyright 1992, 1993, Pi Yee Press, pp. 35-44.

* cited by examiner

METHOD OF PLAYING SINGLE OR MULTIPLE HAND TWENTY-ONE CARD GAME

PRIORITY CLAIM

This application is a continuation application of U.S. patent application Ser. No. 10/053,101, filed on Nov. 13, 2001 now U.S. Pat. No. 6,726,427, entitled "Method of Playing Single or Multiple Hand Twenty-One Card Game," which is incorporated herein in its entirety.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

1. Field of the Invention

This invention relates generally to a method of playing a card game, and more particularly to a method of playing a modified version of Twenty-One, (also known as Blackjack) wherein the player is able to play single or multiple hands against the dealer in either a video, computer game or an actual human game. The game of the present invention can be played in a casino as a card game or a video slot machine. Alternatively, it can be played on a computer and/or as an on-line gambling game over a Wide Area Network such as the Internet, as part of a Local Area Network ("LAN") or on a stand-alone computer.

2. The Prior Art

The objective of "Twenty-One" is to have a hand where the sum of the value of each card comes as close as possible to the number twenty-one, without exceeding it. The game is typically played by one or more players against a house or dealer with the player making a wager on the outcome. The player's hands which are less than or equal to twenty-one, and exceed the value of the dealer's hand are the winning hands. Losing hands are all hands, which have a lower sum than the dealer's hand and all hands that exceed the sum of twenty-one (called a "bust"). Tying hands resulting in no bets won or lost (called a "push") are possible in the game of Twenty-One. A 2-card hand totaling twenty-one is called "Blackjack".

The conventional method of playing Twenty-One involves one or more standard decks of playing cards, with each card worth its face value (Jacks, Queens and Kings are worth 10), except Aces, which are worth either one or eleven depending on which is most beneficial to the count of the hand. The dealer starts the deal by dealing two cards to each wager. The dealer also deals two cards to himself or herself. One of the dealer's cards is dealt face up (called the "up card") and the other card is dealt face-down (called the "down card").

A player may draw additional cards, known as "hitting", in an attempt to try to beat the count of the dealer's hand. However, if the player's hand exceeds twenty-one, then the player has "busted". The player can "stand" on any count of twenty-one or less. Once the player "busts", his or her wager is lost regardless of whether or not the dealer "busts". Each establishment has "house rules" which govern how the game is to be played, and in particular, when the dealer must "hit". House rules can vary from establishment to establishment or game to game. Usually, the dealer must "hit" when he or she has less than seventeen. Some house rules require that a dealer hit when the dealer has an Ace and a six (or multiple cards adding up to six), known as a "soft" seventeen (because an Ace can have the value of either eleven or one). Normally a dealer must stand on a "soft" eighteen, nineteen or twenty.

If the dealer "busts", the player wins, regardless of the player's hand, unless the player has "busted". If neither the player nor the dealer "busts", then the closest hand to twenty-one wins. If a player's hand ties that of the dealer, it is called a "push" and the wager is not lost. Instead the bet is credited back to the player.

"Doubling down" is the procedure of a player doubling his or her original bet after his or her initial 2 cards are dealt, and then drawing a single additional card. In many gaming establishments the house rules restrict this option, often allowing it only if a player's first two cards total ten or eleven. The three-card total becomes the player's hand.

"Splitting" is the procedure of splitting a pair of cards dealt to a player's hand into two hands, by making an additional wager equal to the original wager. One of those wagers is applied to each of the split hands. The player receives a new second card for each of the split hands and each hand is then played out separately. When "splitting" Aces, the player can usually receive only one additional card for each split hand, depending on the house rules.

"Insurance" is a procedure that is available when the dealer's "up card" is an Ace. After each player receives his or her first two cards and the dealer reveals his or her "up card", the player can wager one-half of the amount of his or her original wager as "insurance" against the dealer having a "Blackjack" (a two-card twenty one count). If the dealer has "Blackjack", the player loses the original wager and wins 2-to-1 on the insurance bet. On the other hand, if the dealer does not have a "Blackjack" the player loses the insurance bet and the round continues with respect to the original bet.

"Surrender" varies according to house rules, but when allowed, permits the player to forfeit one-half of his or her bet after the player's first two cards are dealt and evaluated against the dealer's "up card".

U.S. Pat. No. 5,154,429 to Le Vasseur discloses a "21" game wherein the player plays a single hand against multiple dealer hands. If the player is dealt a bad hand, he or she is likely to lose multiple hands, which could be less interesting than playing multiple player hands, at least some of which could be good hands.

U.S. Pat. No. 5,280,915 to Groussman discloses a "21" game whereby the player plays two hands against the dealer.

U.S. Pat. No. 5,954,335 to Moody discloses a "21" game wherein a player plays two or three hands against a dealer and each hand is wagered separately and in a card by card fashion.

Hence, conventional Blackjack games are usually limited as to the number of hands, which can be played by a single player at the same time. This is because in conventional Blackjack, the number of player decisions required increase in proportion to the amount of hands played. Therefore a player attempting to play a large number of hands simultaneously in conventional Blackjack would be overburdened with decisions, causing the play to be very tedious and impractical. Hence, assuming that the maximum bet is placed on every hand, the number of hands that can be played at a time thereby limits the amount that can be wagered in a particular amount of time. Accordingly, such limited number of games can have a tendency to become less interesting to the player over time. Moreover, the revenues generated for the casino or establishments are somewhat limited by the number of hands which can be played by a player at the same time.

SUMMARY OF THE INVENTION

The present invention comprises a card game of "Blackjack" or "21", in which the player is able to play any number of hands (hereinafter referred to as "1 to N" hands) against the dealer (either human or computerized), in a rapid and automatic fashion. Each hand played serves to multiply the amount being wagered. The player initially decides the number of hands to be played against the dealer, and the bet for each hand. As in conventional Blackjack, the player and the dealer are initially dealt two cards each. In the preferred embodiment, each of the player's hands start out with the same initial two cards, and a separate set of deck(s) is used to deal the hits for each player hand, with the initial two player cards removed. Alternatively, the player can be dealt different sets of initial cards for each hand or multiple sets of the same cards for some, but not all of the hands being played. Decks of electronic simulations of the same number and type of cards found in a conventional deck of cards are each shuffled with a uniform random distribution. Other methods of shuffling electronic decks of cards known in the art may also be used.

Depending on the "house rules" of the game or establishment, the player then decides whether to double down, split pairs, take insurance or surrender. In the preferred embodiment of the present invention, where the first two cards are the same for all player hands, any player action taken is automatically duplicated for all hands being played. Therefore any decision to double down split pairs, take insurance or surrender is then duplicated across all hands being played. Next the player predetermines whether or not to "hit", that is to draw additional card(s) to improve the player's hands. If the decision is made to "hit" the hands, the player selects the numerical value to which a hand will continue to be "hit" (the "stand value"). Once the value of each hand reaches or exceeds the selected level, the hand will no longer be automatically "hit". In the preferred embodiment, a special case is made for 'soft' hands. If the player has a 'soft' hand (an Ace with the value of 11) the soft hand is automatically hit until it exceeds soft 17 regardless of the "stand value" selected. All hands will then be played out and all player hands will be hit until the hand reaches or exceeds the selected "stand value". The dealer then plays out his or her hand and the player hands are settled as in conventional Blackjack. In this way the player with a single decision can control the hitting of (1-n) hands with any strategy desired, eliminating the laborious card by card decision making process in the prior art.

In the preferred embodiment, the player has an additional option to "auto-play" the hand. In this case all decisions regarding splitting, doubling, insurance, surrender, hitting and standing are automatically computed by a computer. The advantage is the player has no decisions to make and can play very rapidly with a favorable strategy, without having any expertise in the game. By watching the auto-play run, the less skilled player can also learn how to improve his or her blackjack play decision-making.

An alternate version of the invention involves dealing all player and dealer hands from a single set of decks. This results in two different cards dealt to begin each player hand. The player then makes decisions whether to split, double, take insurance, or surrender depending on the house rules. These decisions could be made on a hand-by-hand basis, but this could prove very tedious when a large number of hands are involved. A more automated process of decision-making is described as follows.

The single insurance decision can be duplicated across all hands, since it is a bet on the dealer's down card, and does not involve the player's hand. If it is possible for the player to split any of his multiple hands, the player chooses to split, and then a ranking of split hands is displayed. Similar to the "hit" selection previously described, the player with a single decision, decides to split all paired hands at or above a certain ranking, and not to split those hands below that ranking, ("the split value"). The player would base this decision on his interpretation of the strength of the dealer's up card 28, as shown in FIG. 1A, for example. In this way, a near optimal strategy can be achieved with a single decision. Likewise, if a player elects to double, a ranking of doubled hands is displayed (11, 10, 9, etc.) and the player with a single decision elects to double all those hands at or above a certain rank (the "double value"). Likewise, "surrender values" or "insurance values" can be set by the player so that all hands below a certain value are automatically surrendered and/or all hands above a certain value are automatically insured.

For example, doubling all hands 10 or greater would result in the doubling of hands of value 10 and 11 respectively. Again the decision would be based upon the player's interpretation of the strength of the dealer's up card. As in the preferred embodiment the player would have the option to have the computer auto-play the player's hand based upon a computer executed strategy, removing all decision making responsibility from the player and speeding up play further. This would be attractive to the less skilled player.

Other versions of the invention can provide that each player is independently dealt different cards for each hand, without any intentional duplication of the hands. Moreover, rather than have each "hit" or "stand" decision being uniformly applied to each player hand, the player can be required or permitted to make independent decisions as to some or all of the player hands. The game of the present invention can be played on a conventional personal computer ("PC") or a computer-controlled video game such as a video poker or slot machines, or manually dealt by a dealer. Other methods of play should be considered as being within the scope of the invention.

One version of the invention comprises a method of playing a modified version of Twenty-One (Blackjack) wherein a player plays and wagers on multiple hands against the hand of the dealer, using at least one conventional deck of 52 playing cards having established numerical values for each playing card pursuant to the applicable rules, comprising one or more of the steps of:

a) selecting the number of player hands to play against the dealer's hand;

b) selecting the wager to be placed on the hands of the player;

c) dealing a pre-selected number of cards as a first set of cards dealt to each of the player's hands and a first set of the cards dealt to the dealer's hand;

d) determining whether to "double down", "split pairs", "take insurance" or "surrender" with respect to the player's hand as allowed by house rules;

e) deciding the point value ranking to which the player's hands will be hit to;

f) hitting at least one of the player's hands automatically until the value of each hand is at least the point value or stand value;

g) playing out the hand of the dealer according to the applicable rules; and, h) determining which of the player's hands are winning hands.

The wager to be placed on the hands of the player can be equal for all player hands.

The first set of cards dealt to each of the player's hands are identical for each of the player's hands and duplicated from multiple sets of decks of playing cards assigned to each of the player's hands. The hitting of all of the player's hands continues until the stand value is reached or exceeded on each hand, automatically. The first set of cards dealt to each of the player's hands are randomly selected from different sets of decks and are not intentionally duplicated for all of the player's hands.

The steps of determining whether to "double down", "split pairs", "take insurance" or "surrender" with respect to the player's hand are automatically decided for at least one of the player's hands. A point value ranking is selected by the player for one or more of these decisions, which is then automatically applied to all of the player's hands. The first two cards dealt to each of the player's hands are the same and comprise the pre-selected number of cards dealt as a first set of cards to each of the player's hands. The pre-selected number of cards dealt as a first set of cards to the dealer's hand comprises one card dealt face up and a second card dealt face down. The player can, in an alternative embodiment, play against multiple dealer hands.

Another method of the present invention comprises playing a modified version of Twenty-One (Blackjack) wherein a player plays and wagers on at least one hand against the hand of the dealer, using at least one conventional deck of 52 playing cards having established numerical values for each playing card pursuant to the applicable rules, comprising one or more of the steps of:

a) selecting the number of player hands to play against the dealer's hand prior to the initial deal;

b) selecting the wager to be placed on the hands of the player prior to the initial deal;

c) dealing a pre-selected number of cards as a first set of cards dealt to each of the player's hands and a first set of the cards dealt to the dealer's hand;

d) electing to have the computer automatically play out the player's multiple hands with respect to "double down", "split pairs", "take insurance", "surrender", and whether or not to "hit" each hand, and how many cards to hit each hand with, and all other decisions with respect to the player's hand;

e) playing out the hand of the dealer according to the applicable rules; and, f) determining which of the player's hands are winning hands.

The wager to be placed on the hands of the player can also be equal for all player hands. The first set of cards dealt to each of the player's hands can be identical for each of the player's hands and duplicated from multiple decks of playing cards assigned to each of the player's hands. Hitting of all of the player's hands until the value of each of the player's hands is at least equal to the decided point value (or stand value) can be applied to each hand automatically. The first set of cards dealt to each of the player's hands can be randomly selected from different sets of decks and are not intentionally duplicated for all of the player's hands. Determining whether to "double down", "split pairs", "take insurance" or "surrender" with respect to the player's hand can be automatically decided for at least one of the player's hands.

The first two cards dealt to each of the player's hands can be set to be the same for each hand and comprise the pre-selected number of cards dealt as a first set of cards to each of the player's hands. Alternatively, only one card can be the same for all hands. Likewise, more than 2 cards can be the same for each of the player's hands. The pre-selected number of cards dealt as a first set of cards to the dealer's hand comprises one card dealt face up and a second card dealt face down. The player can alternatively play against multiple dealer hands.

The invention comprises a modified version of Twenty-One (Blackjack) wherein a player plays and wagers on at least one hand against the hand of the dealer, using at least one conventional deck of 52 playing cards having established numerical values for each playing card pursuant to the applicable rules in an attempt to result in at least one winning hand, requiring multiple strategic decisions which includes: a computing device for controlling or executing the game; a display device operably connected to the computing device; one or more dealer hands displayed on the display device; multiple player hands displayed on the display device; means for computing the numerical value of the player hands; means for determining whether any of the player hands are winning hands; and, means for pre-selecting a strategy for substantially automatically making subsequent strategic decisions for the player.

One version of the present invention is the modified version of Twenty-One (Blackjack) wherein a player plays and wagers on multiple hands against the hand of the dealer, using at least one conventional deck of 52 playing cards having established numerical values for each playing card pursuant to the applicable rules in an attempt to result in at least one winning hand, requiring multiple strategic decisions, and comprising: a computing device for controlling the game, and the computing device having a screen display. One or more dealer hands are displayed on the screen display and multiple player hands are displayed on the screen display. The computing device is capable of dealing additional cards to the dealer hand and said player hands. Means are provided for computing the numerical value of the player hands and the dealer hands. Means are also provided for comparing the player hands to the dealer hands and determining the winner as well as for electing to have one or more of the strategic decisions executed substantially automatically for the player. Means can also be provided for electing to have the strategic decisions pre-selected automatically for the player at the beginning of the game. That way, as decisions come up during play, such decisions are made for the player by the game, according to the strategy selected by the player or the game.

Means are provided for playing multiple player hands against at least one dealer hand. Means are also provided for computing the value of at least one of the player hands so as to reduce the number of computations to be made by the player. Also provided are means capable of substantially, automatically executing at least one of the strategic decisions for the player so as to reduce the number of strategic decisions made by the player.

There is often the need to streamline the play of conventional "21" games in order to allow a player to play multiple hands simultaneously in rapid fashion while minimizing the number of decisions that need to be made by the player. With conventional "21", as a player becomes fatigued, the rate at which the decisions are made can decrease, thereby adversely affecting the pace and quality of play and tending to discourage that player and other players from continuing to play.

On the other hand, if too many decisions are automatically made for an experienced player, the player could lose interest because the game is not deemed to be challenging enough.

An object of the present invention is therefore to enable a player to play multiple hands at the same time, while adjusting the level of difficulty and if desired, tailoring the number and nature of the decisions to be made by the player if desired, so as to create greater interest for the player, through a perception of greater winning potential for the player and providing potentially greater revenues for the casino or gambling establishment.

It is another object of the present invention to enable a player to play a greater number of Blackjack hands and/or place a greater number of wagers in a period of time.

It is yet another object of the present invention to create an improved Blackjack game and game layout that can be played accurately and efficiently in a computer based, on-line gambling or video poker or slot machine game type format.

A further object of the present invention is to make it easier for the player to gamble for longer periods of time, since the conventional wisdom is that the longer a player plays, the more revenue will likely be generated for the casino or gambling establishment, on the average.

These and other objects will become apparent in light of the following specification, drawings and claims.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

Figure 7:
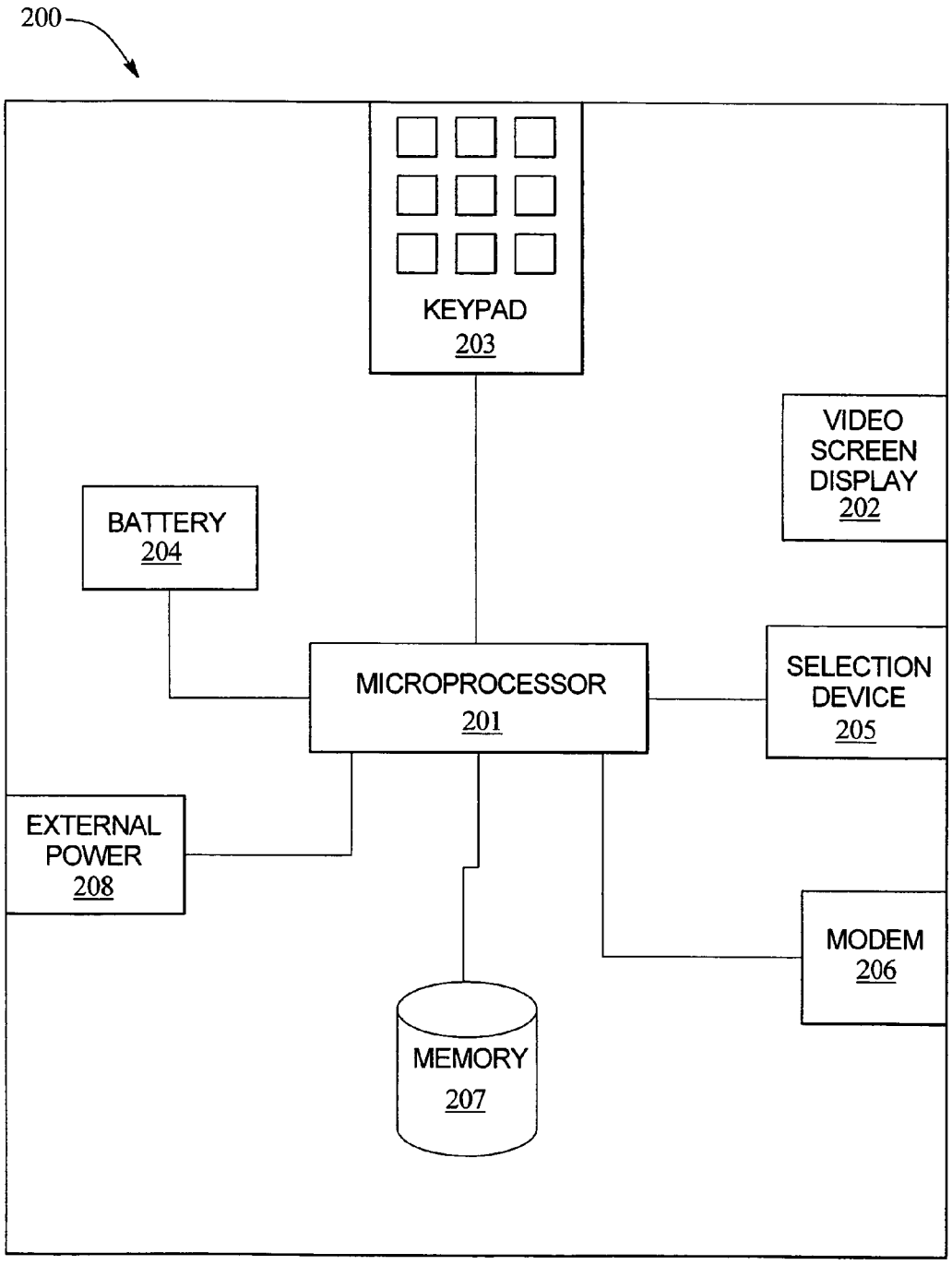
FIG. 7 is a schematic diagram of a computer controlled video slot or poker game or a personal computer.

Turning to FIG. 7, the game of the present invention can be played on a computer controlled video slot or poker game or a personal computer having such components operably connected to and controlled by microprocessor 201 as: video screen display 202 which can be a touch screen; keypad 203 and/or selection device 205 which can be a mouse, trackball, stylus, touch pad, touch screen and/or other input device; memory 207; external power 208 and/or battery 204. Likewise, it can be played by using conventional decks of cards and a human dealer. Hence, the dealer in these examples, can be either human or the computer.

Figure 1A:
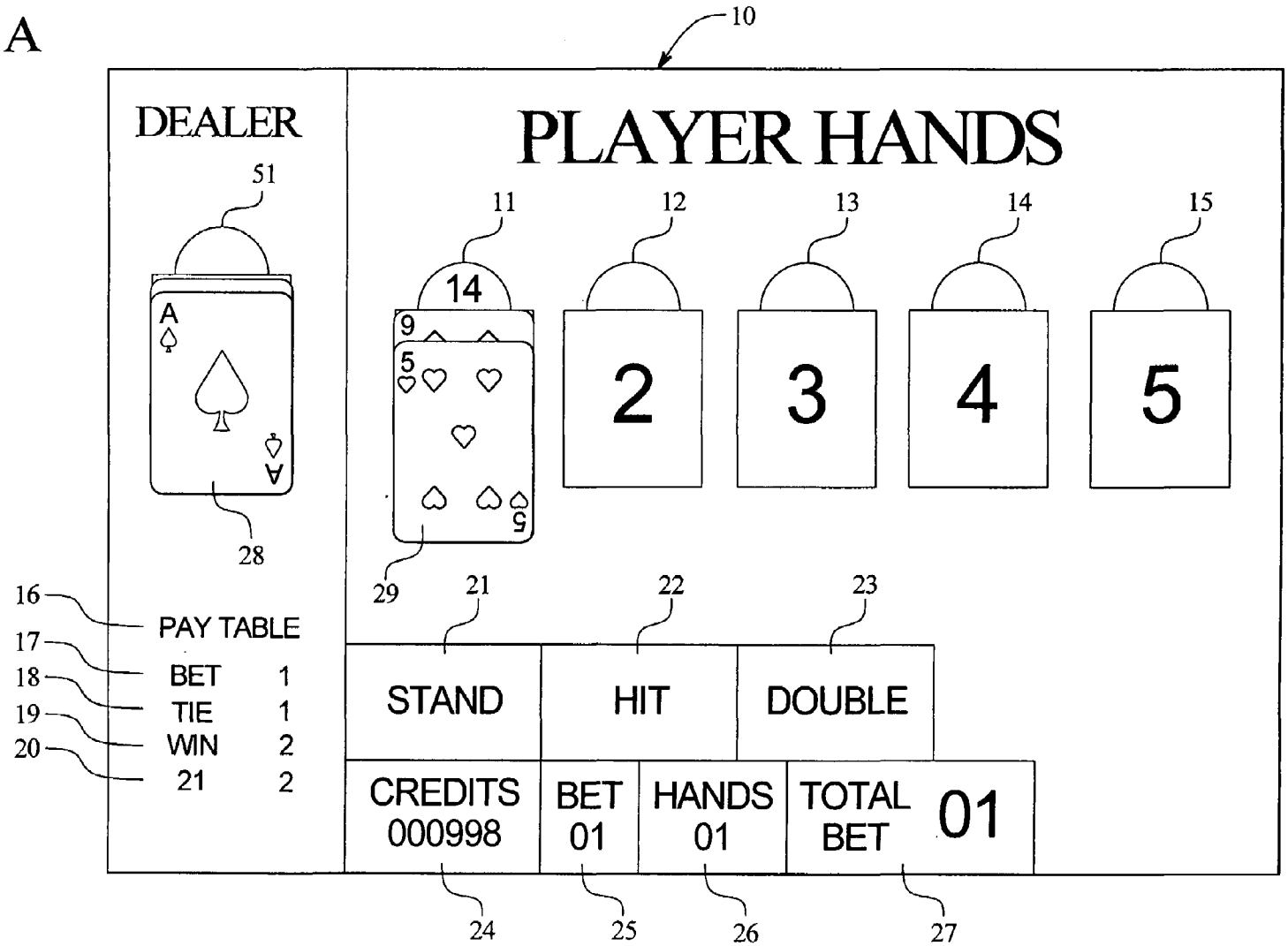
FIG. 1A is an illustration of a screen display of a first example of a single hand version of the present invention.

FIGS. 1A–1D and FIGS. 2A–2B illustrate an example of a single hand version of the preferred embodiment. In this example, the player has selected to play and wager on only one hand. However, other numbers of player hands can be selected for other examples of the invention and should be considered as being within the scope of the invention. As shown in FIG. 1A, the simulated Blackjack table 10 of the computer-based or video game version of the present invention includes dealer card area 51 and player hand areas 1-N (which in this example are 1–5) provided with reference numerals 11–15.

Pay Table 16 indicates the payouts to the player for different game results and bets. Also provided are manual or simulated electronic selection buttons such as "Stand" 21, "Hit" 22 and "Double" 23. Selection buttons 21–23 can be activated by manually depressing them (if they are in the nature of electrical or electromechanical contact switches of the type found in computer-controlled video poker or slot machine games). If selection switches 21–23 are simulated switches of the type shown on computer or video game screens, in a computer based version of the game, then switches 21–23 are activated by moving the cursor (by using arrow keys or a mouse or the like) to such areas and using such selection devices as a mouse, touch pad or roller ball, or touch screen to activate such switches. If the screen is a touch screen, then the switches are activated by contacting the designated area. The total balance of remaining credits or dollars is shown by credit readout 24. The amount of the bet is ordinarily deducted from the remaining balance for the player, as soon as the hand is started. Also shown are bet selection button 25, hands selection button 26 and total bet indicator 27 which are used by the player to select the amount bet and the number of hands played at one time, respectively, so as to display the product of these two numbers as the Total Bet 27.

Figure 1B:
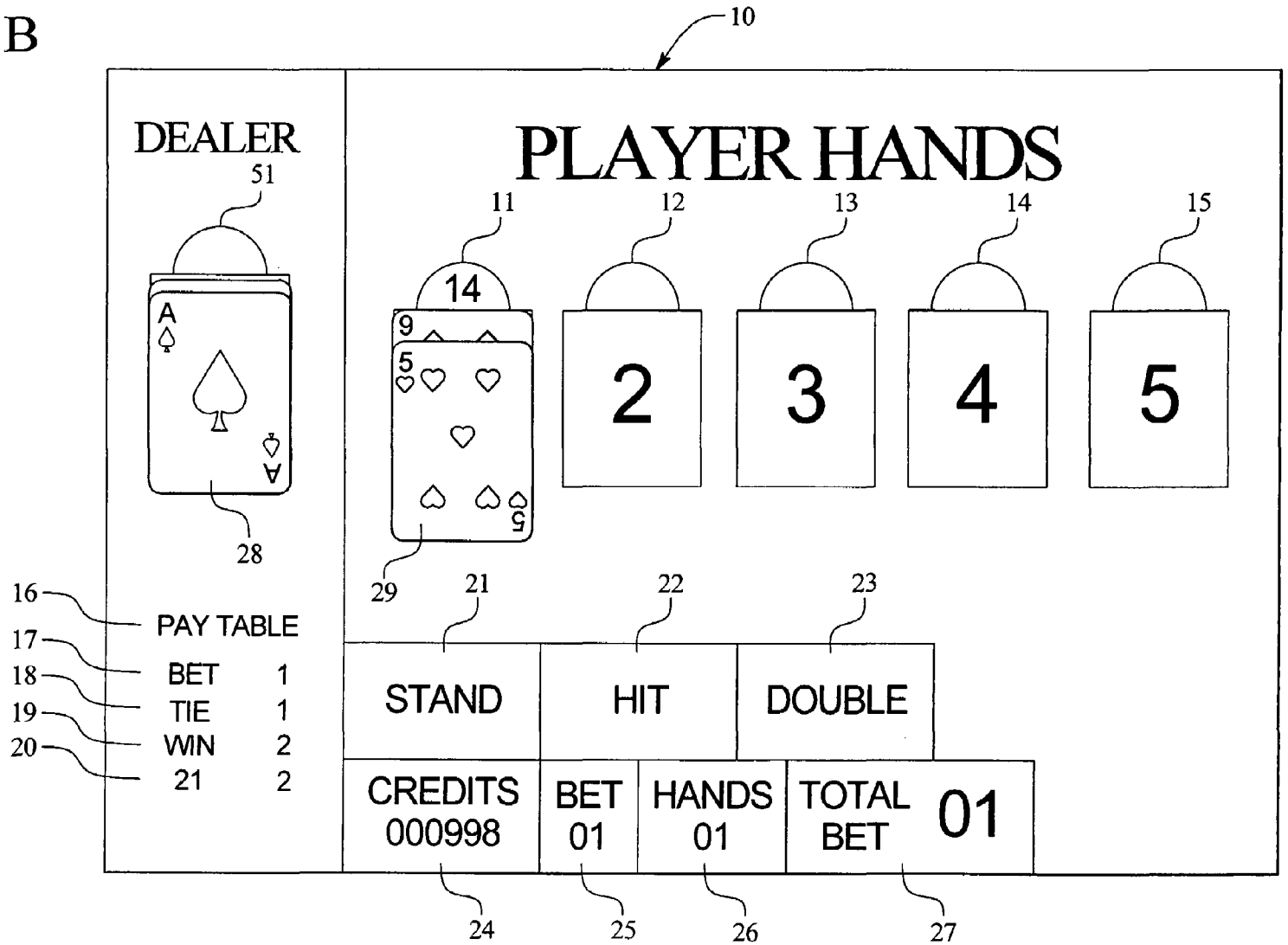
FIG. 1B is yet another illustration of a screen display for the first example.
Figure 1C:
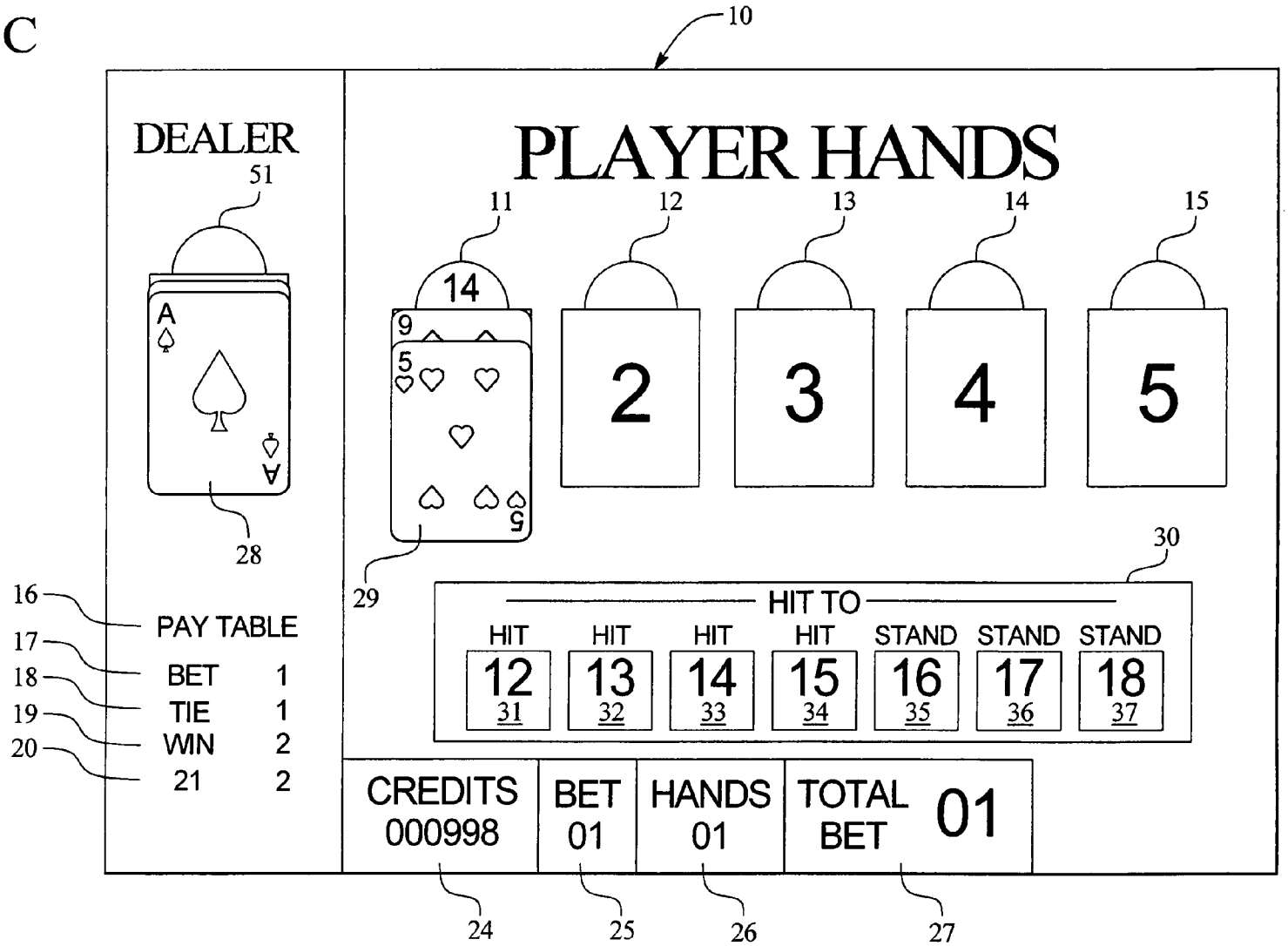
FIG. 1C is another illustration of a screen display for the single hand version showing a "hit to" or stand value selection display.
Figure 1D:
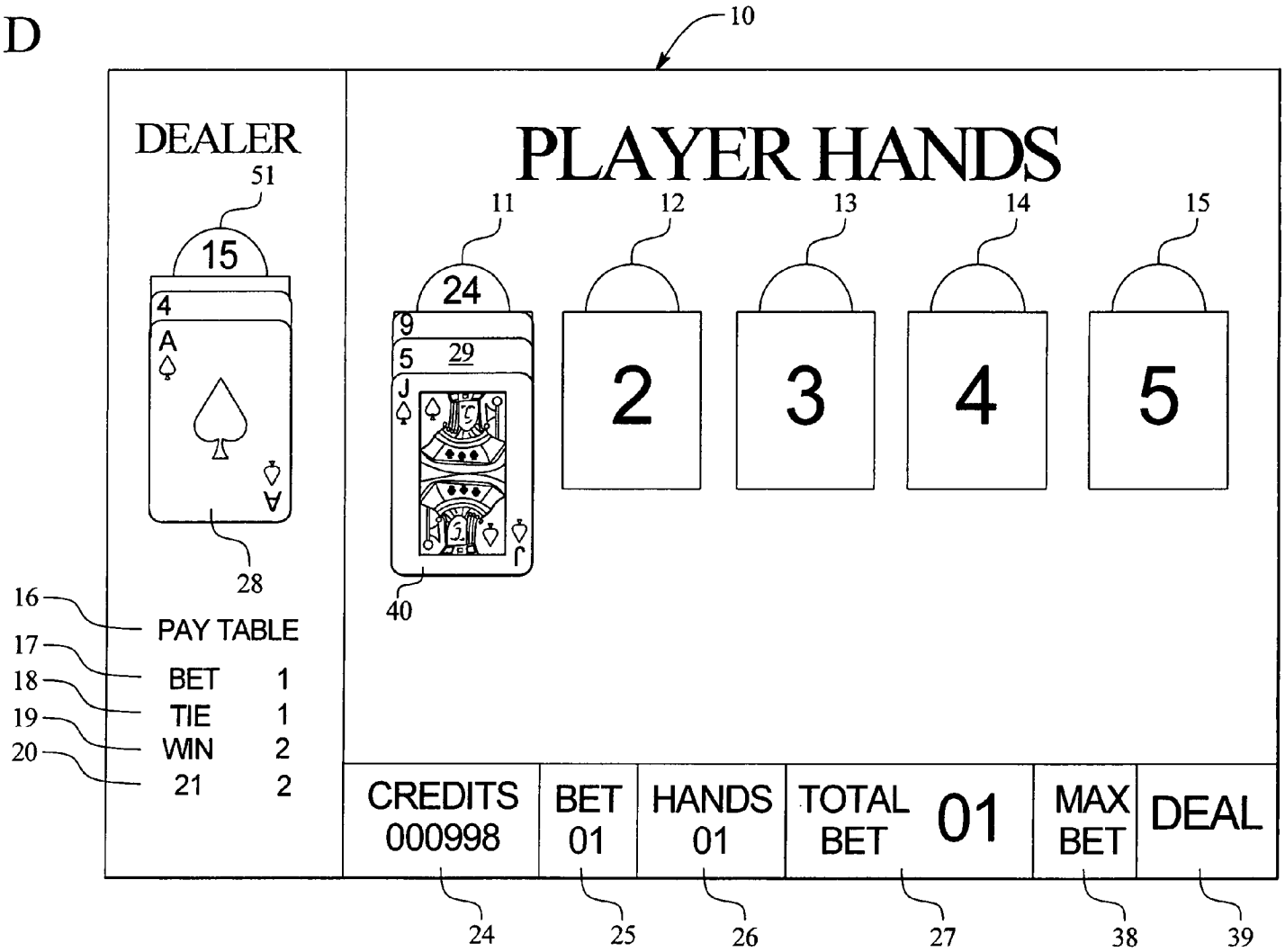
FIG. 1D is yet another illustration of a screen display for the first example showing the dealer's cards turned-up.

As shown in FIGS. 1A–1D, the player was dealt a nine and a five so as to be a 2-card hand (29) of fourteen while the dealer shows an Ace as his or her "up card" (28). As shown in FIG. 1B, the player decides to "hit" (take a card) against the dealer's hand by selecting or activating the "hit" button 22. Selection of "hit" button 22 results in display of "Hit To" selection display 30 which contains "Hit To" buttons 31–37, in place of the buttons for Stand 21, Hit 22, and Double 23, as shown in FIG. 1C. "Stand 16" button 35 is selected because the player has chosen to "hit" on 15 or below and "stand" on sixteen and above. Because as shown in FIG. 1D, the player is dealt a Jack 40 (worth ten), the player "busts" with a hand having a total value of twenty four. The "Max Bet" button 38 (which enables the player to automatically wager the maximum allowed wager for the next hand) and the deal button 39 (to initiate the dealing of the next hand) can be selected in the previously described manner. These buttons appear and operate in the same manner, regardless of how many hands have been played.

As shown in FIG. 1D, once all of the dealer's cards are turned up, dealer card space 51 reveals the total value of the dealer's hand, which in this case is fifteen. Likewise, player's hand spaces 11–15 reveal the total value of each of the player's hands and update the total value as each new card is dealt. Accordingly, the number of calculations and/or decisions, which must be performed by the player, can be reduced or eliminated.

Figure 2A:
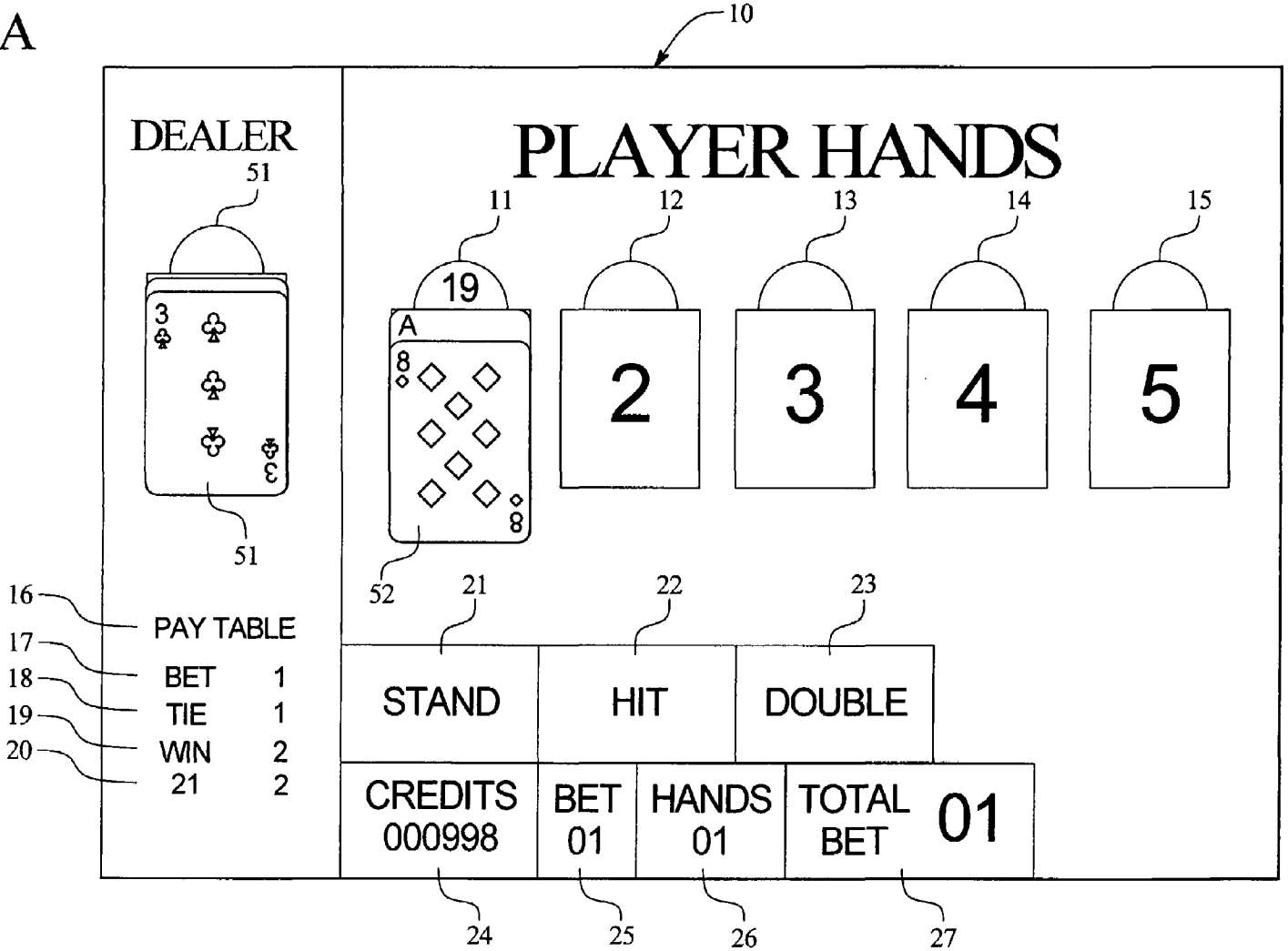
FIG. 2A is an illustration of a screen display of a second example for the single hand version of the present invention.
Figure 2B:
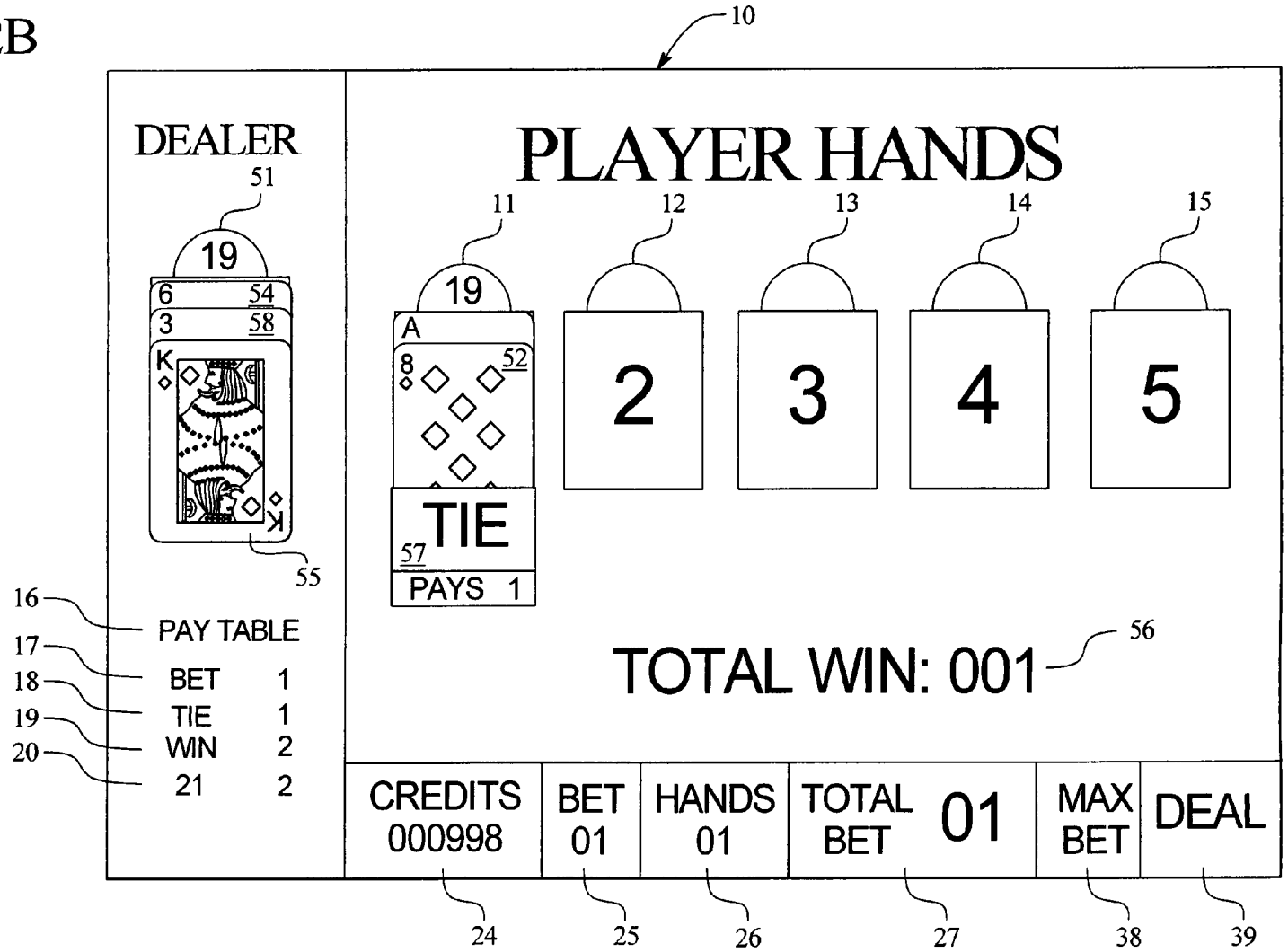
FIG. 2B is yet another illustration of a screen display of the second example showing the dealer's cards turned-up.

FIGS. 2A & 2B show another example of a single-hand game of 21. In the example of FIGS. 2A and 2B, the player is dealt an Ace and an eight, which is referred to as a "soft nineteen" because it can have a value of either nine or nineteen—depending on whether the value of the Ace is selected by the player to be either one or eleven. The dealer's 'up card' is a three. Accordingly, the player selects stand button 21.

As shown in FIG. 2B, as play continues, the dealer shows that the bottom card 54 is a six giving him or her a total of nine. Because the dealer must "hit" a hand of nine under house rules, another card is dealt to the dealer. The additional card 55 dealt to the dealer is a King (worth ten) giving the dealer a total of nineteen. Accordingly, the result is a tie or "push" because the value of the player's hand equals the value of the dealer's hand and accordingly, the bet is returned to the player. The displays which read "TOTAL WIN: 001" 56 and "TIE: Pays 1" 57 appear. Display 56 replaces the buttons for Stand 21, Hit 22 and Double 23. The Pay Table 16 and credits readout 24 results are then updated. Dealer card area 51 reflects the total value of the dealer's hand, while player's hand area 11 reflects the total value of the player's hand. The displays, readouts, pay table, dealer card area, player card areas operate in a similar fashion, regardless of how many hands are played at the same time by the player.

An example of a player playing five hands at once is shown in FIGS. 3A–3D. While and example is shown and described wherein the player is playing five hands at once, the player can choose to play more or fewer hands at the same time. In this five-hand version of the invention, the player is dealt and starts with the same two cards in each of the five hands being played. The player has been dealt two Kings 62 and 63 (each worth 10). Player hand areas 11–15 each reflect the total two-card hand value of twenty. Dealer area 51 shows "up card" 51 having a value of three and hidden dealer "down card" 64. Because the player's hands contain pairs of cards having the same value, the "Split" button 65 automatically appears. Because the player is betting 10 Credits per hand as reflected by Bet button 25 and is playing five hands as reflected by hands button 26, the total bet readout 27 shows that the total bet amount for all hands being played by that player is 50 Credits. Likewise, at this time the player decides whether to take "insurance" or "surrender" based upon conventional play of "21" and the controlling house rules.

Figure 3A:
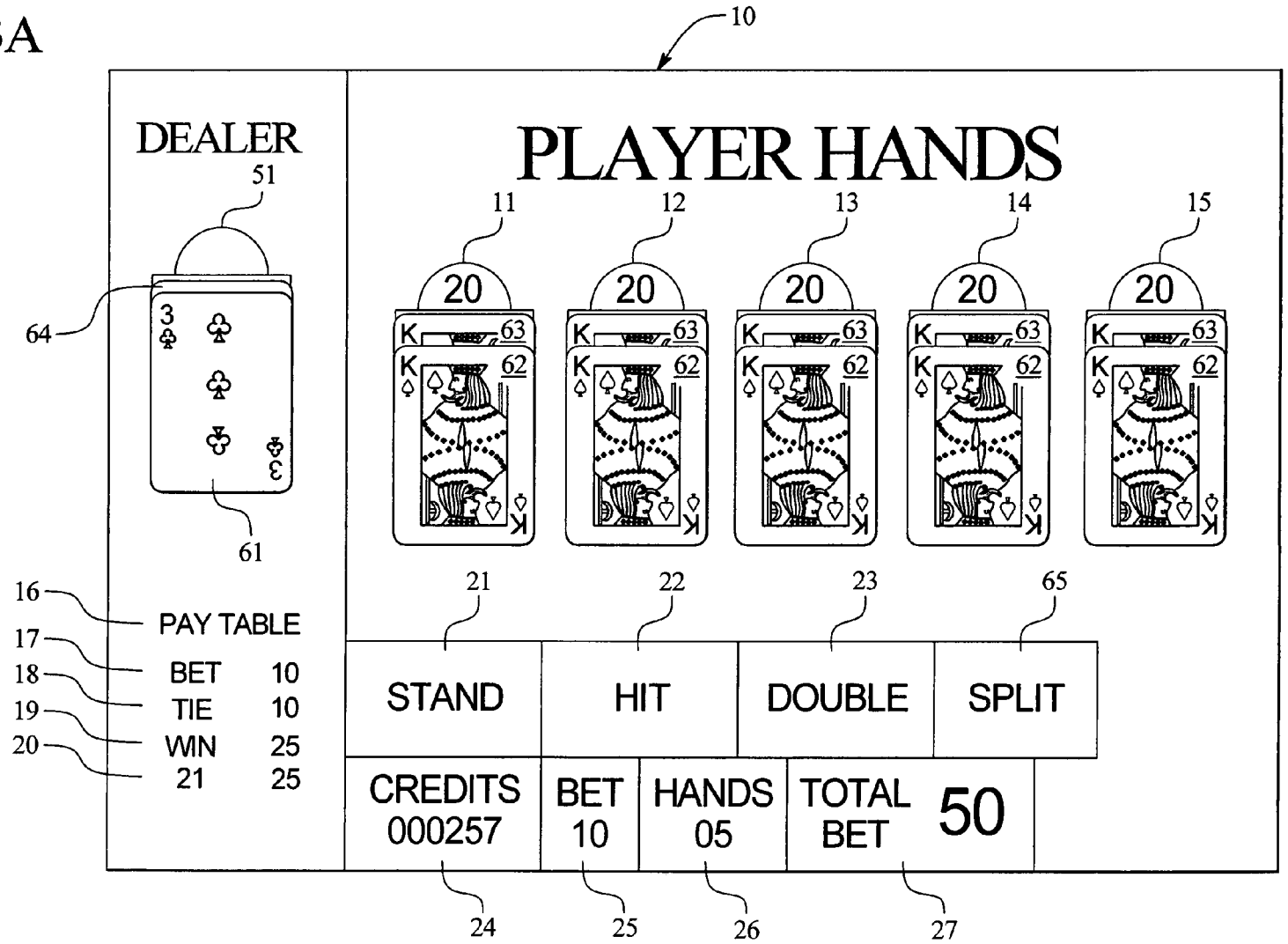
FIG. 3A is an illustration of a screen display of a second example of a multiple hand version of the present invention.
Figure 3B:
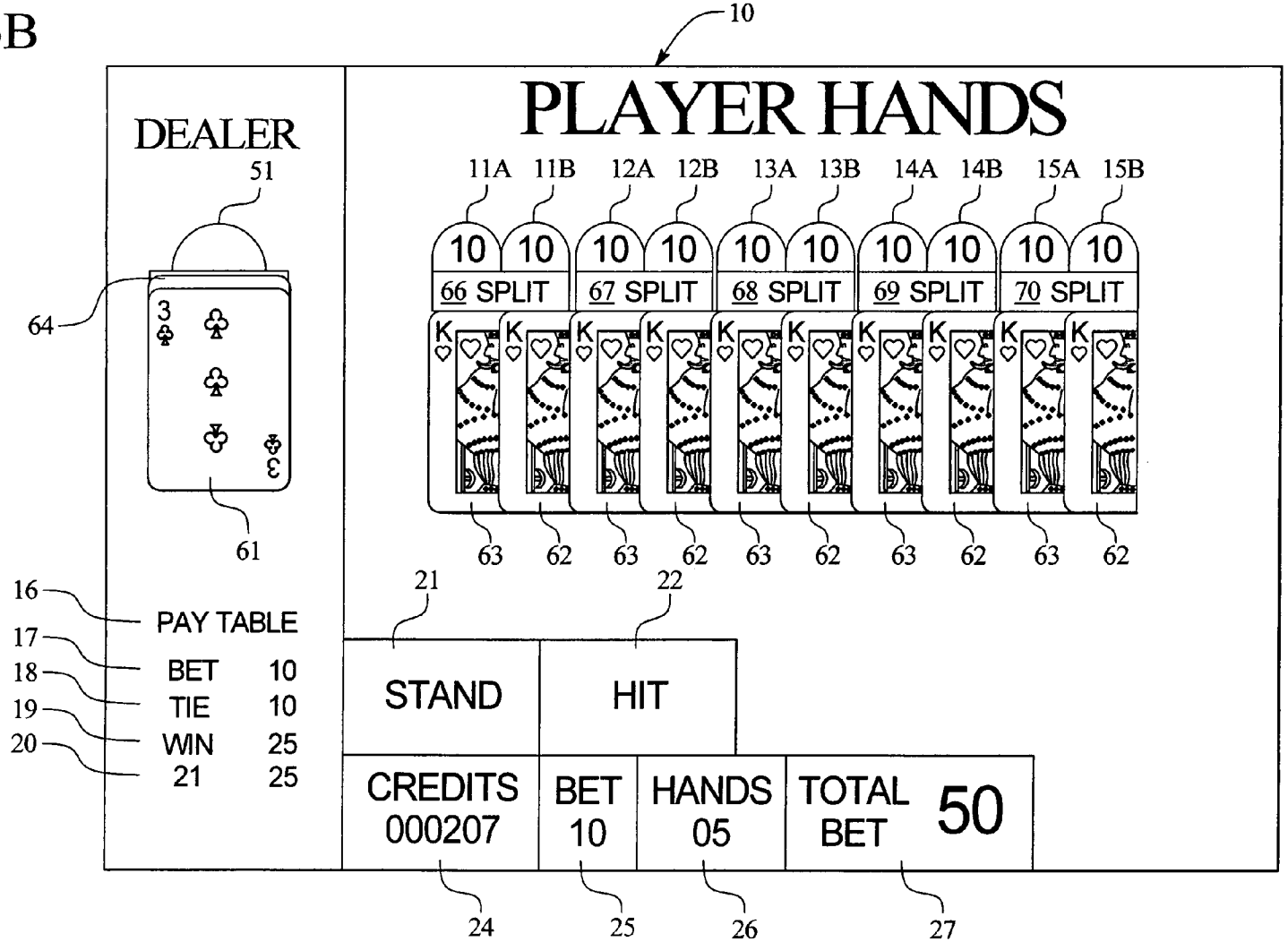
FIG. 3B is another illustration of a screen display of the second example showing the player splitting five pairs of kings.

As shown in FIGS. 3A and 3B, if the player decides to "split" the pairs of Kings (which is a somewhat unorthodox strategy), into separate hands (each of which starts with one of the Kings), by supplementing the bet by adding the amount of the original bet to each new split hand, the split button 65 is activated. Turning to FIG. 3B, player hand areas 11–15 are split into player hand areas 11A and 11B through 15A and 15B. Player hand areas 11–15 each reflect that each of Kings 63 and 62 is worth ten. Split signs 66–70 appear on player hand areas 11A and 11B through 15A and 15B.

In order to "hit" or take a card on all of these ten hands, the player activates the hit button 22. Bet indicator 15 is now updated to reflect that the five original bets have been doubled to ten bets to reflect the splitting of the five pairs of Kings 62 and 63. Total Bet indicator 27 now reflects a total bet of ten bets multiplied by five hands to equal 50 Credits.

Figure 3C:
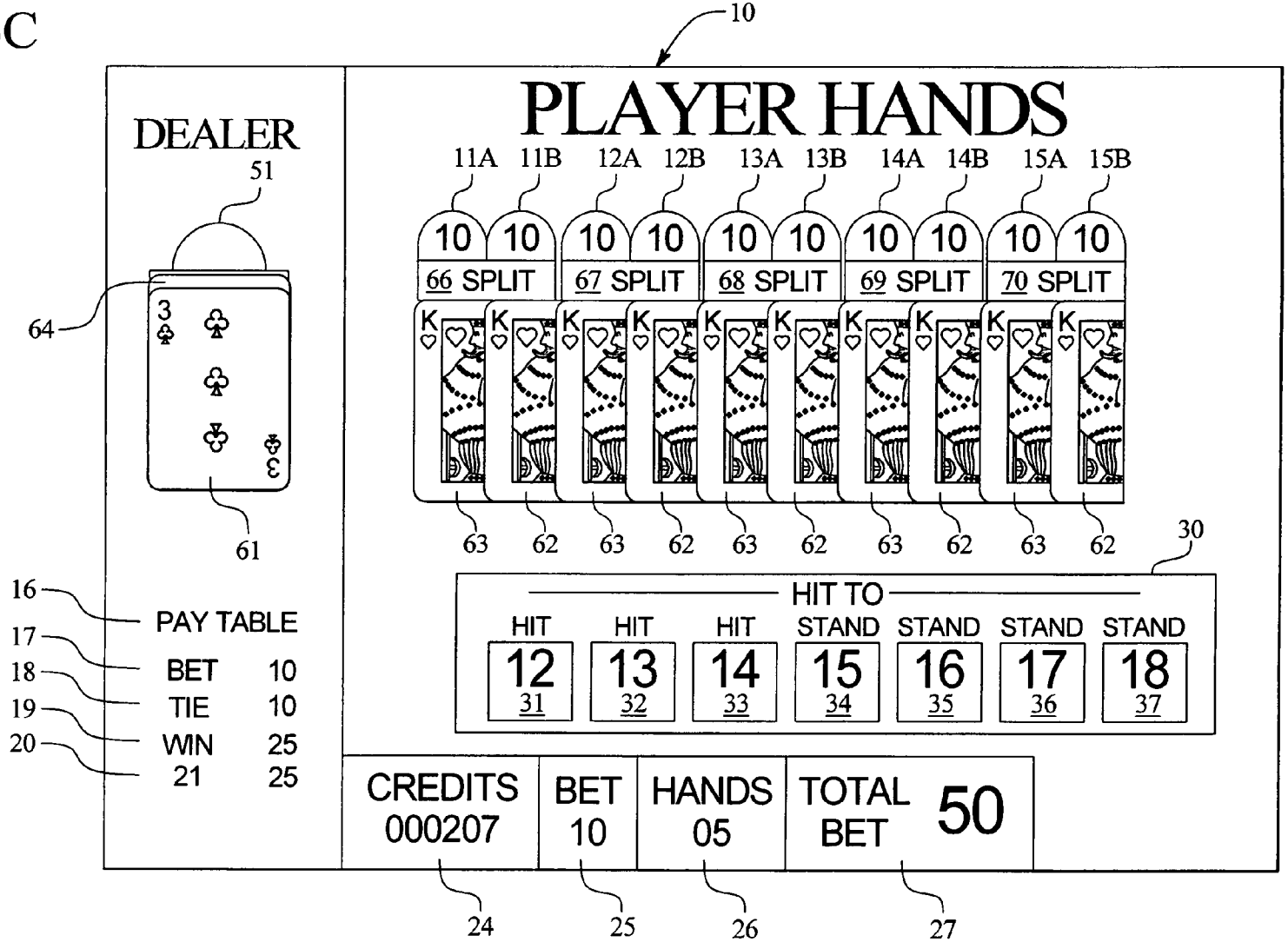
FIG. 3C is yet another illustration of a screen display of the multiple hand version showing the "hit to" or stand value selection display.
Figure 3D:
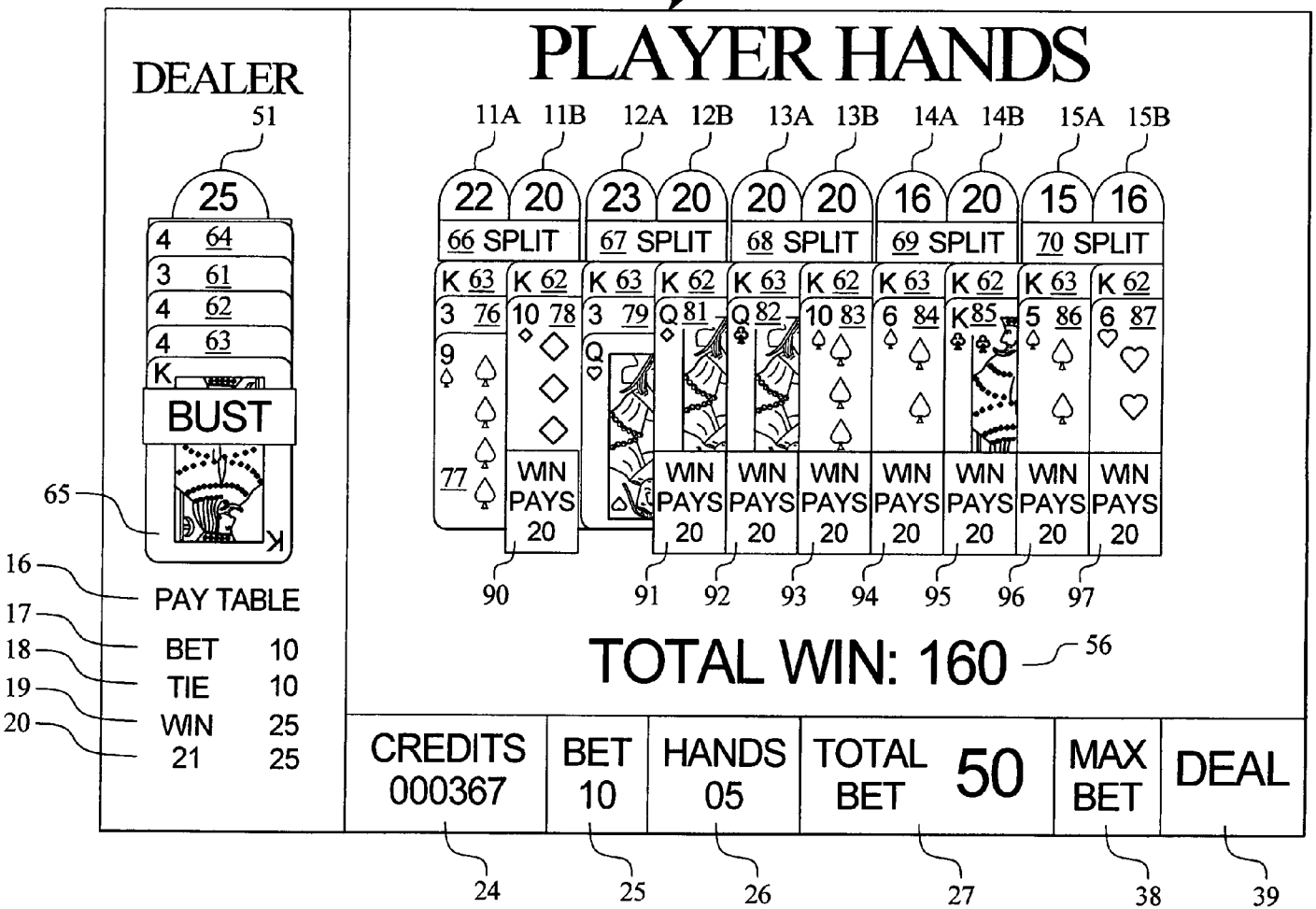
FIG. 3D is yet another illustration of a screen display of the second example showing the totals for the hands.

In this example of FIG. 3C, the "Hit To" display 30 appears and the player selects the "Hit to 15" button 34, in response to the dealer's "up card" 61 being a three. Accordingly, the game will automatically keep dealing cards to each of the ten split hands 11A and 11B to 15A and 15B until the value of the hand reaches or exceeds fifteen. The outcome of this decision by the player is shown in FIG. 3D wherein: cards 76 and 77 are dealt to hand 11A resulting in a "bust"; card 78 is dealt to hand 11B; cards 79 and 80 are dealt to hand 12A resulting in a "bust"; card 81 is dealt to hand 12B; card 82 is dealt to hand 13A; card 83 is dealt to hand 13B; card 84 is dealt to hand 14A; card 85 is dealt to hand 14B; card 86 is dealt to hand 15A; and card 87 is dealt to hand 15B. This "auto hit" feature of the invention is applicable to situations where the player is playing either a single hand or multiple hands.

No cards were dealt to player hands 11B, 12B, 13A, 13B, 14A, 14B, 15A and 15B, as shown in FIG. 3D, because the value of those two-card hands equaled or exceeded fifteen, in compliance with the "stand value" resulting from the player activation of the "Hit to 15" button 34. Because the two-card value of hand 11A was thirteen (ten for card 63 and three for card 76), additional card 77 (which was a nine) was dealt causing the player to "bust" on that hand. Similarly, because the two-card total of cards 63 and 67 of hand 12A was 13, additional card 80 (worth ten) was dealt, causing the player to "bust" on that hand as well.

As shown in FIG. 3D, the total values of hands 11A and 11B through 15A and 15B are shown in each respective player hand area 11–15. Because dealer two-card hand of cards 61 (worth three) and 64 (worth four) required the dealer to hit under house rules, card 62 (worth five) was dealt, bringing the three-card dealer total to a value of twelve. Hence, card 63 (worth three) was dealt to the dealer.

Since the four-card total was fifteen, card 65 (worth ten) gave the dealer a total of twenty-five as shown in area 51, so as to "bust". Winning signals 90–97 appear to tell the player which of the ten hands were winners and how much was won. That way the computations required of the player are minimized or eliminated. Total Win Sign 56 is updated and shows the total amount won on that series of hands.

Figure 4A:
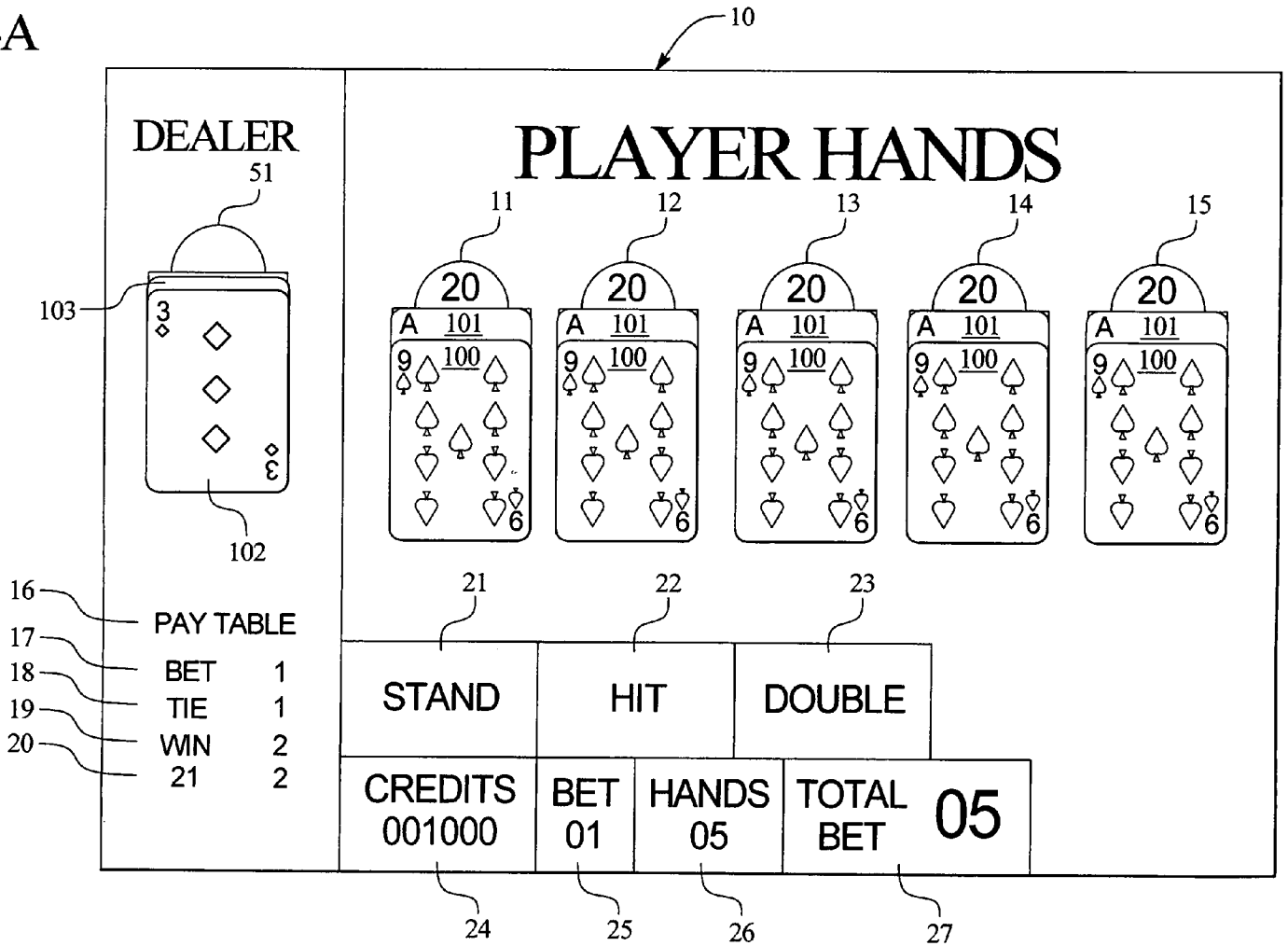
FIG. 4A is an illustration of a screen display of a third example of the multiple hand version of the present invention.

Turning to FIG. 4A, in this example, the player is playing five hands 11–15 (though virtually any other number of hands is possible), the dealer's "up card" 102 is a three and the "down card" 103 in dealer area 51, is not revealed. The player is dealt a "soft 20" comprising card 100 (worth nine) and card 101 (worth either one or eleven). The player could choose to treat the value of hands 11–15 as either ten or twenty. If the player chooses to "stand" with twenty, he or she will not "hit", but will instead activate the Stand button 21.

Figure 4B:
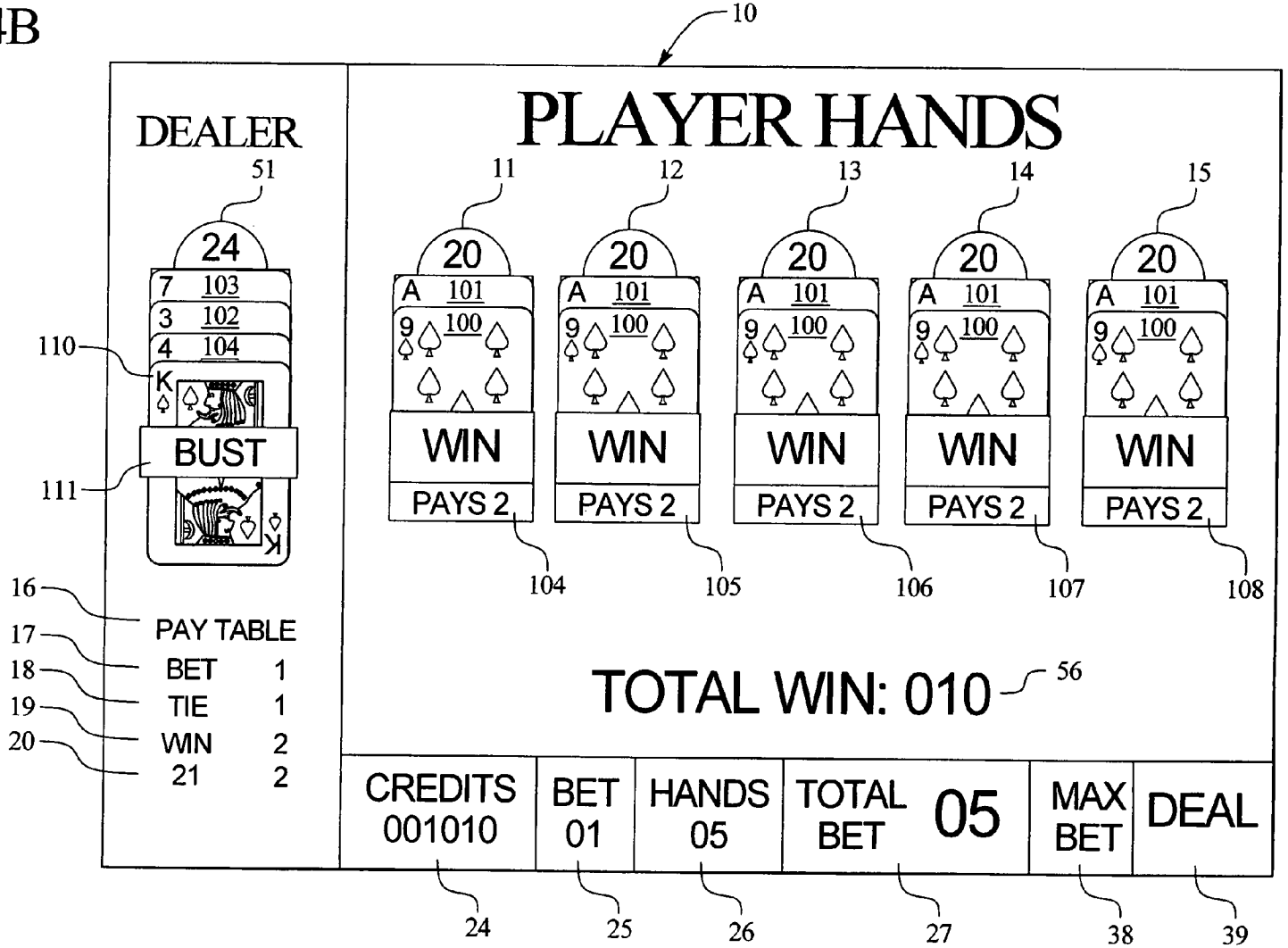
FIG. 4B is another illustration of a screen display of the third example showing the totals for the hands.

Continuing to FIG. 4B, the results are as follows: because the player "stood" on all five hands 11–15, no additional cards were dealt to the player's hands; the dealer's down card 103 (was worth seven) giving the dealer a two-card total of ten; and additional card 109 worth four gave the dealer a three-card total of fourteen requiring the dealer to take additional card 110 worth ten. Since the dealer's total hand was worth twenty-four as shown by dealer hand area 51, the dealer "busts" and the bust sign 111 appears. Win signs 104–108 stating that each winning hand pays 2 Credits appears on each hand. Total win readout sign 56 appears to inform the player that the total winnings for hands 11–15 are 10 Credits. Credits readout 24 is updated. The total value of each of the player's hands 11–15 is shown above the cards. The value of the dealer's hand is shown in Area 51, once the dealer has received all of his or her cards. The "bust" signs and "win" signs operate the same way regardless of how many hands are being played.

Figure 5A:
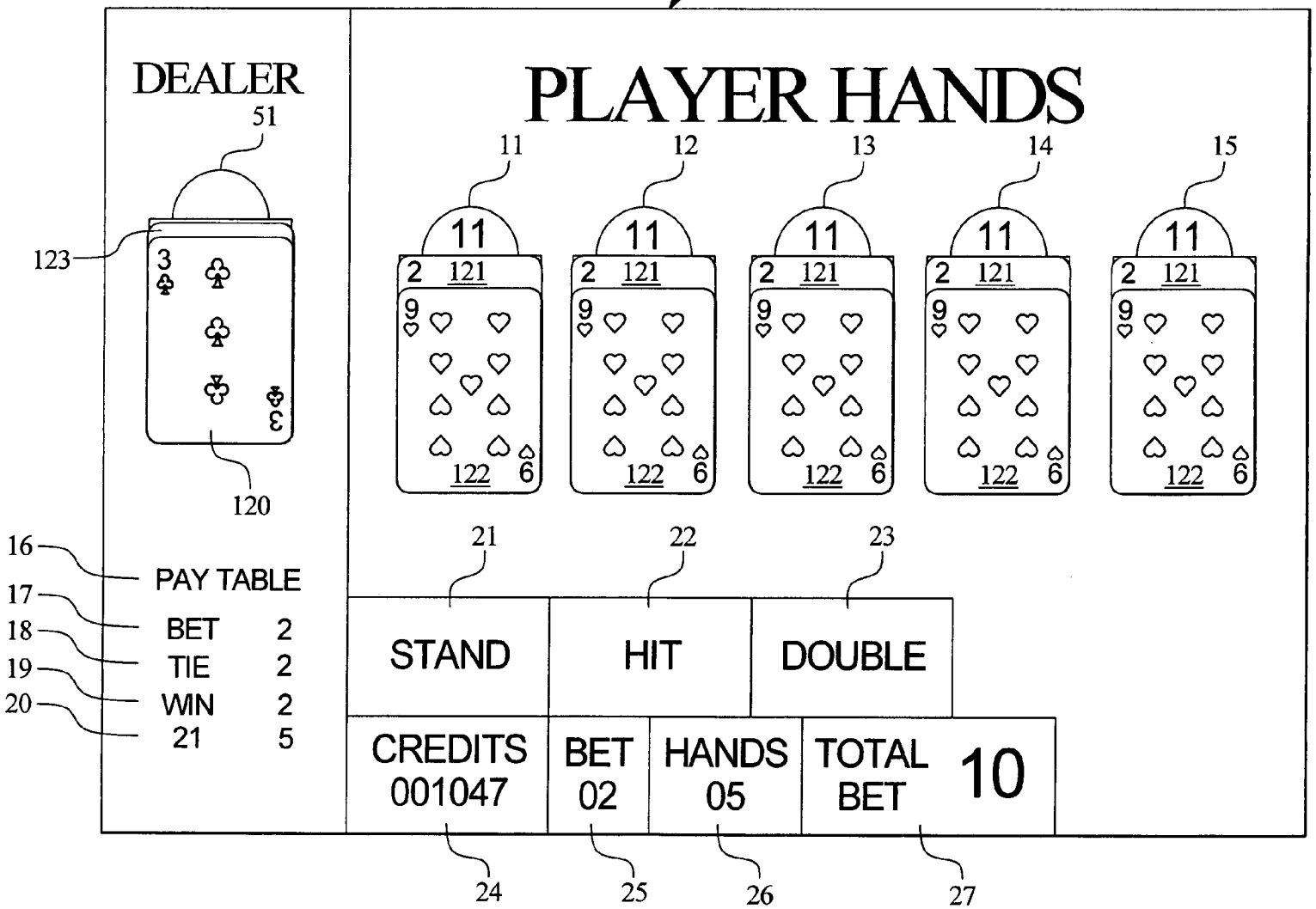
FIG. 5A is an illustration of a screen display of a fourth example of the multiple hand version of the present invention in which the player has chosen to "double down".
Figure 5B:
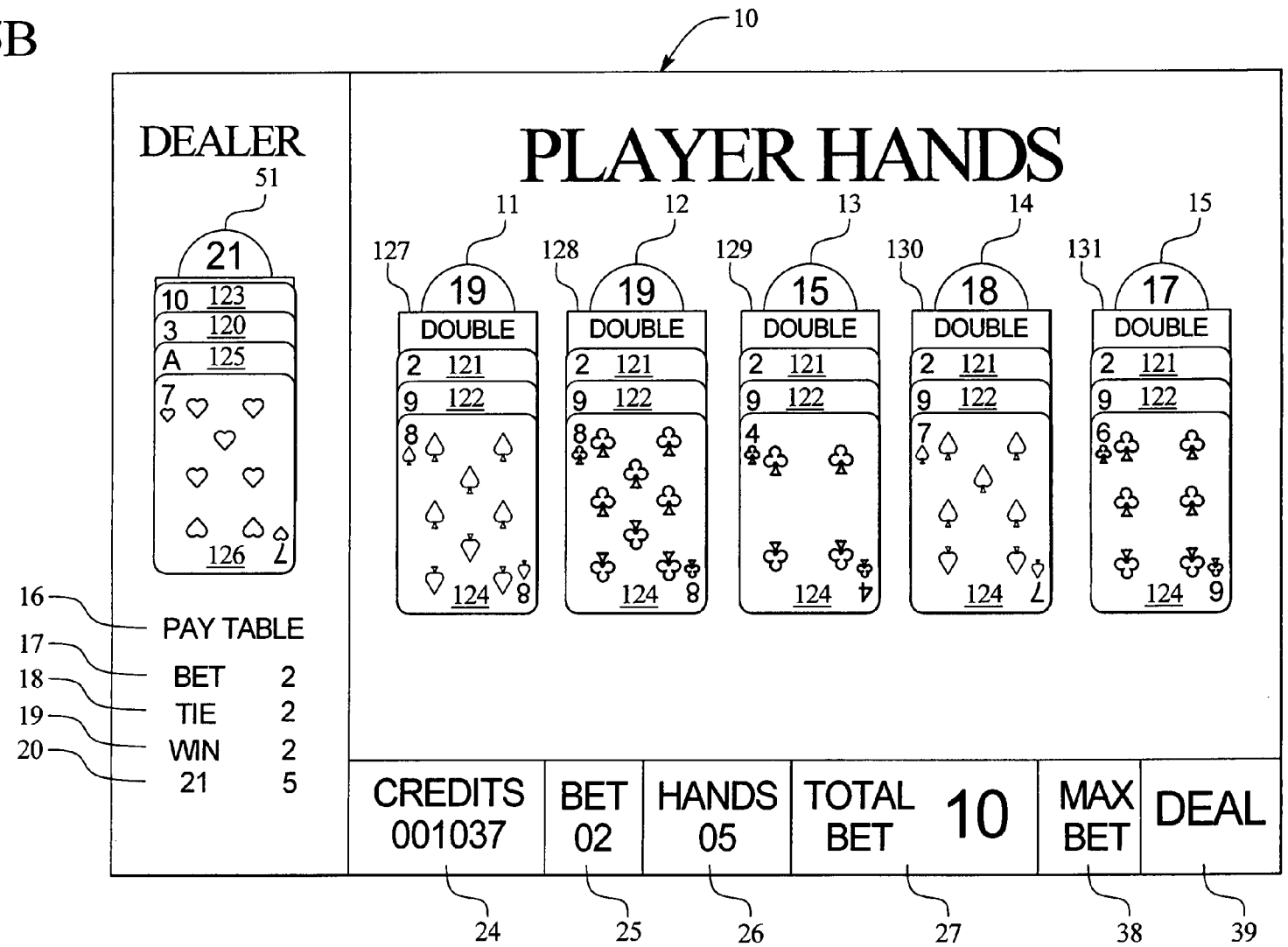
FIG. 5B is another illustration of a screen display of the fourth example.

"Doubling down" with multiple player hands is shown in FIGS. 5A and 5B. Dealer hand area 51 of FIG. 5A, has been dealt "up card" 120 (worth three) and "down card" 123 (value unknown). Player card areas 11–15 show the value of cards 122 and 121, which in this case total eleven. Because player two-card hand total of eleven is allowed to double under house rules, double button 23 appears. Because the five hands 11–15 have the value of eleven, and the dealer's "up card" 120 is a three, the player chooses to "double down". By doubling the initial bet of 2 Credits per hand as shown by Bet indicator 25, the dealer is dealt additional card 124 (worth eight) and as shown in FIG. 2B, double indicators 127–131 appear on each "doubled" hand. The value of each hand is shown for player hands 11–15. The dealer's "down card" 123 is a ten, giving the dealer a two-card total of thirteen. The dealer then is dealt card 125, which is an Ace resulting in a three-card total of fourteen (because the Ace is worth either one or eleven). Because the dealer must "hit" on thirteen according to house rules, card 126 is dealt to the dealer which is a seven, giving the dealer the total value of twenty one, as shown by dealer card area 51. As a result, the player loses all five hands 11–15, because all of the hands have a total of less than twenty-one.

Figure 6A:
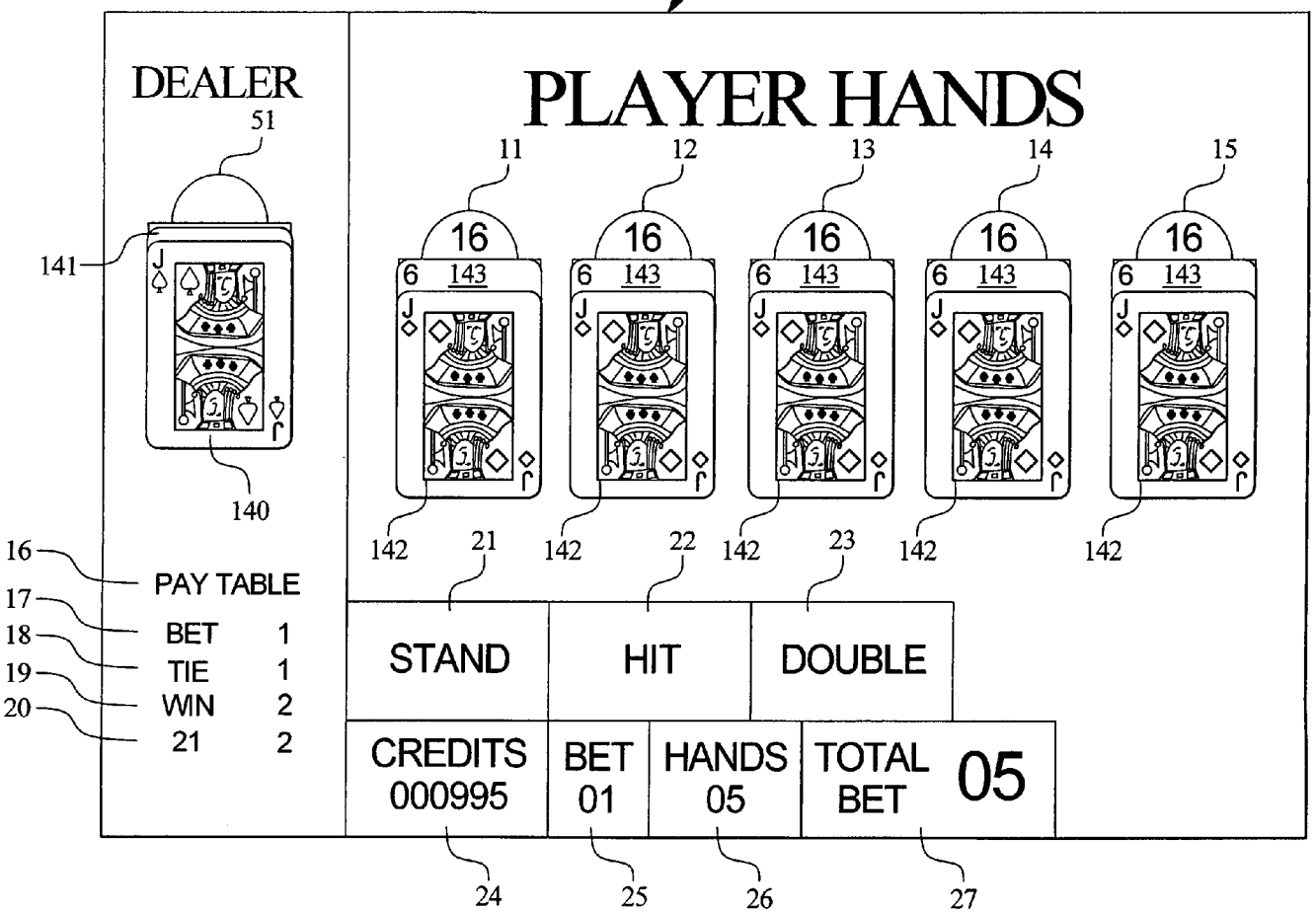
FIG. 6A is an illustration of a screen display of a fifth example of the multiple hand version of the present invention.
Figure 6B:
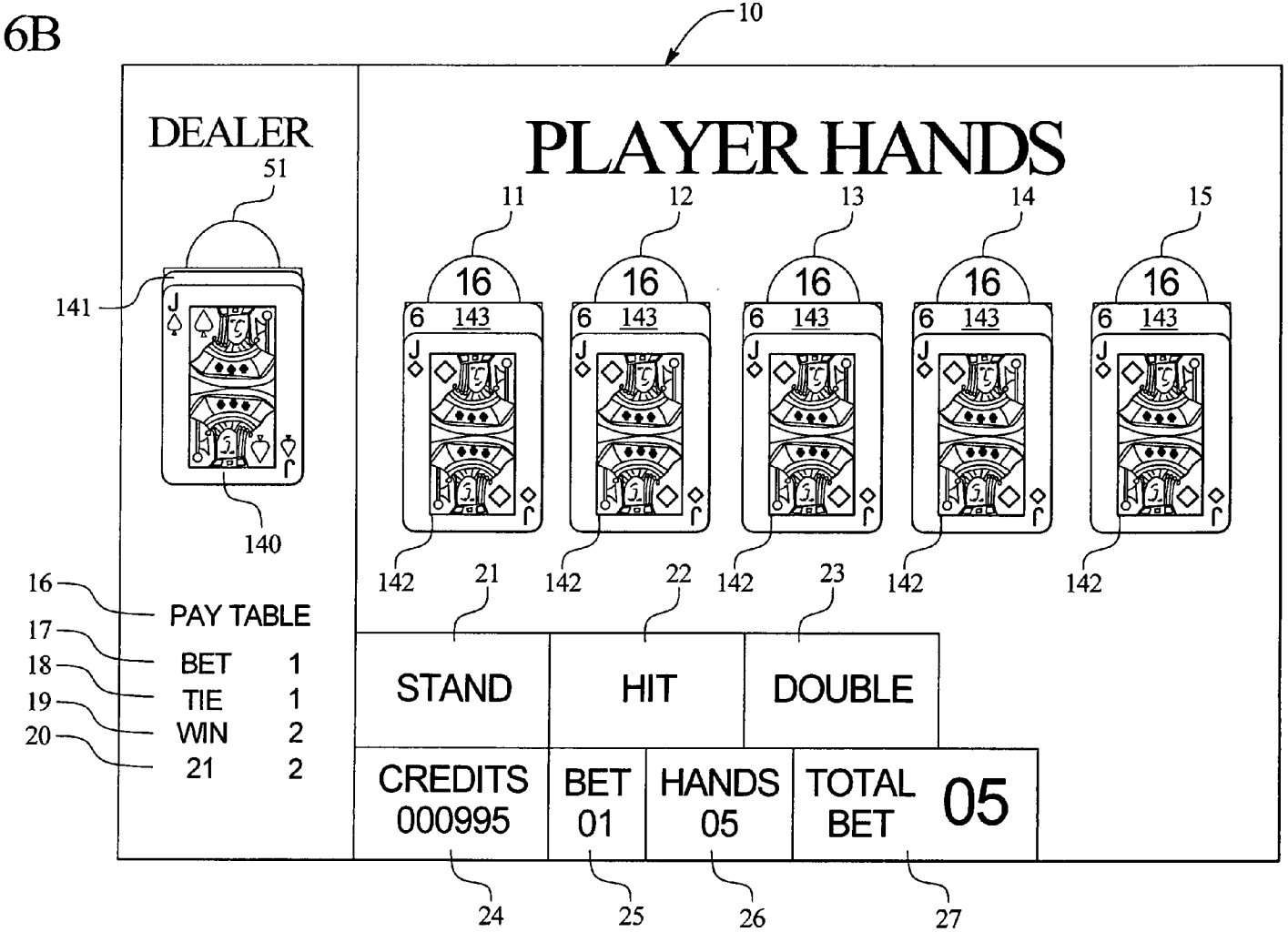
FIG. 6B is another illustration of a screen display of the fifth example.
Figure 6C:
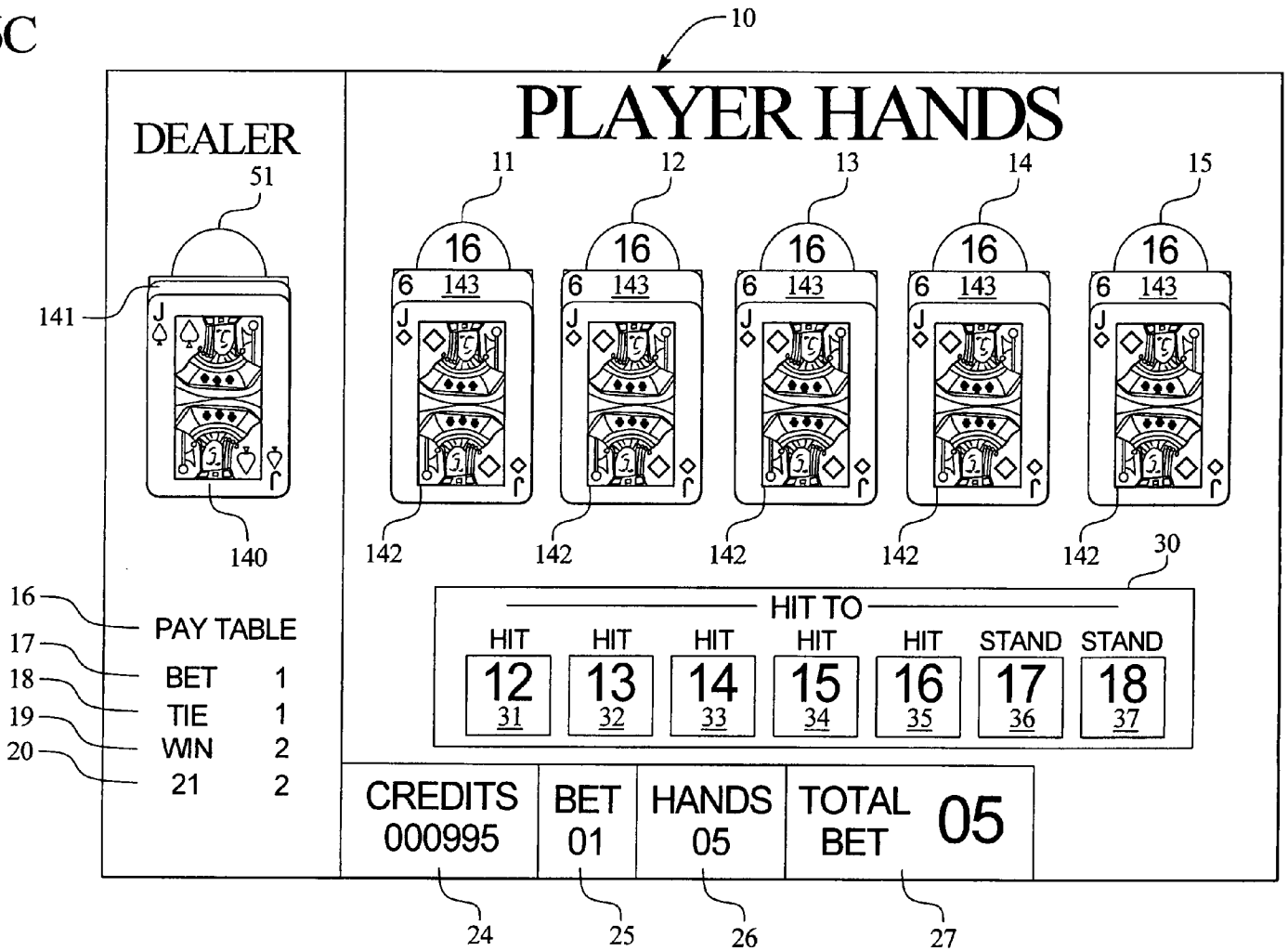
FIG. 6C is yet another illustration of a screen display of the fifth example showing the "hit to" or stand value display.
Figure 6D:
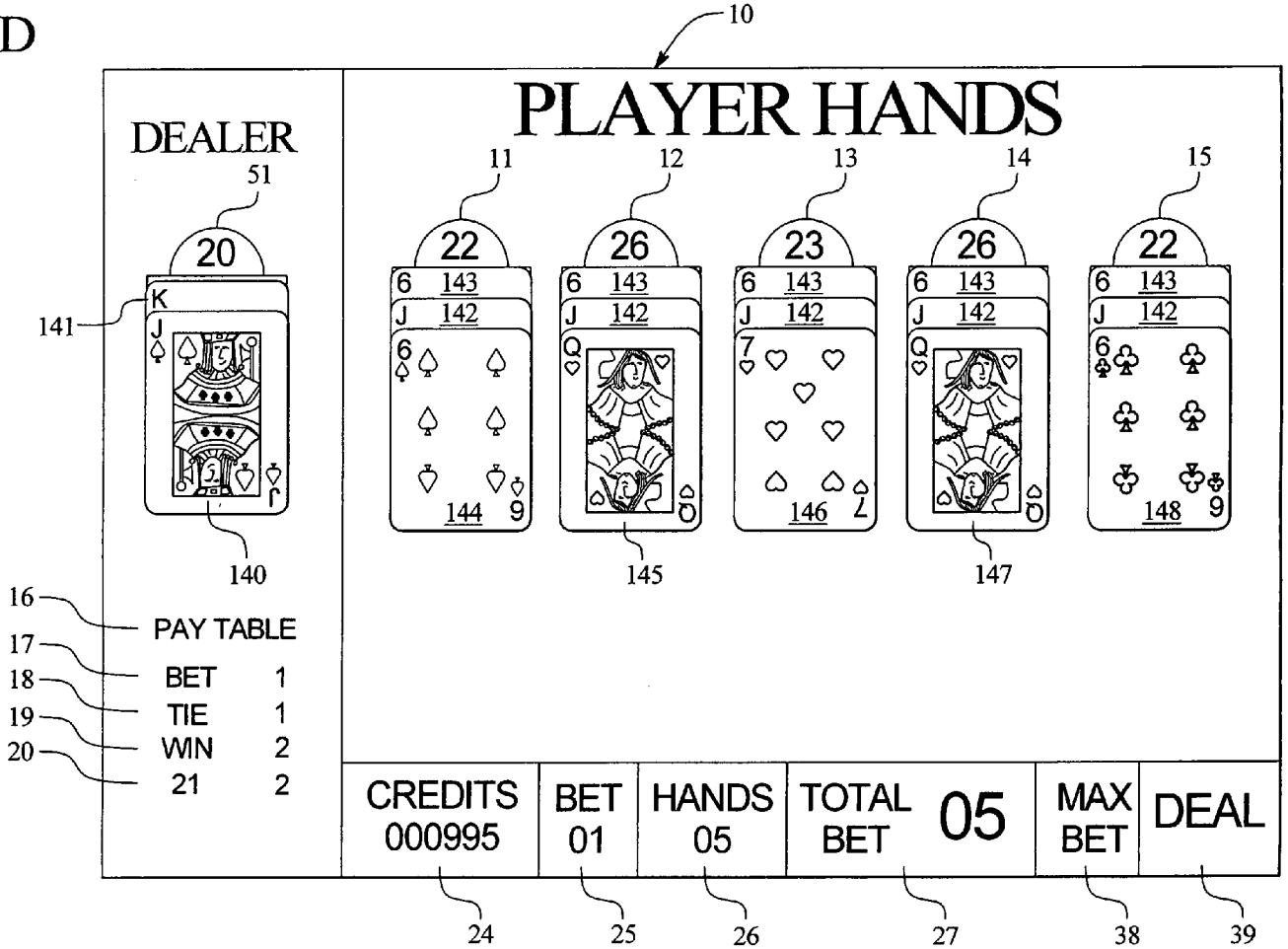
FIG. 6D is another illustration of a screen display of the fifth example showing the dealer's cards turned-up.

In the example of FIGS. 6A–6D, the player is dealt cards 142 and 143 totaling sixteen for each of hands 11–15 as shown thereon. The dealer's up card 140 is a Jack (worth ten) and the down card value is hidden. The player selects the hit button 22 of FIG. 6B and as shown on FIG. 6C, the "Hit To" bar 30 appears. The player selects the "Hit To 17" button 36 of FIG. 6C and all hands below 16 are hit until a value of seventeen or more is reached. Turning to FIG. 6D, additional cards 144–148 are dealt to each of the hands 11–15, respectively. Because the value of each player hand 11–15 exceeds twenty-one as shown there above in FIG. 6D, the player loses every hand, because he or she "busts out." The dealer's down card is revealed and is a Jack (worth ten), giving the dealer twenty as shown at area 51, in FIG. 6D.

Figure 8:
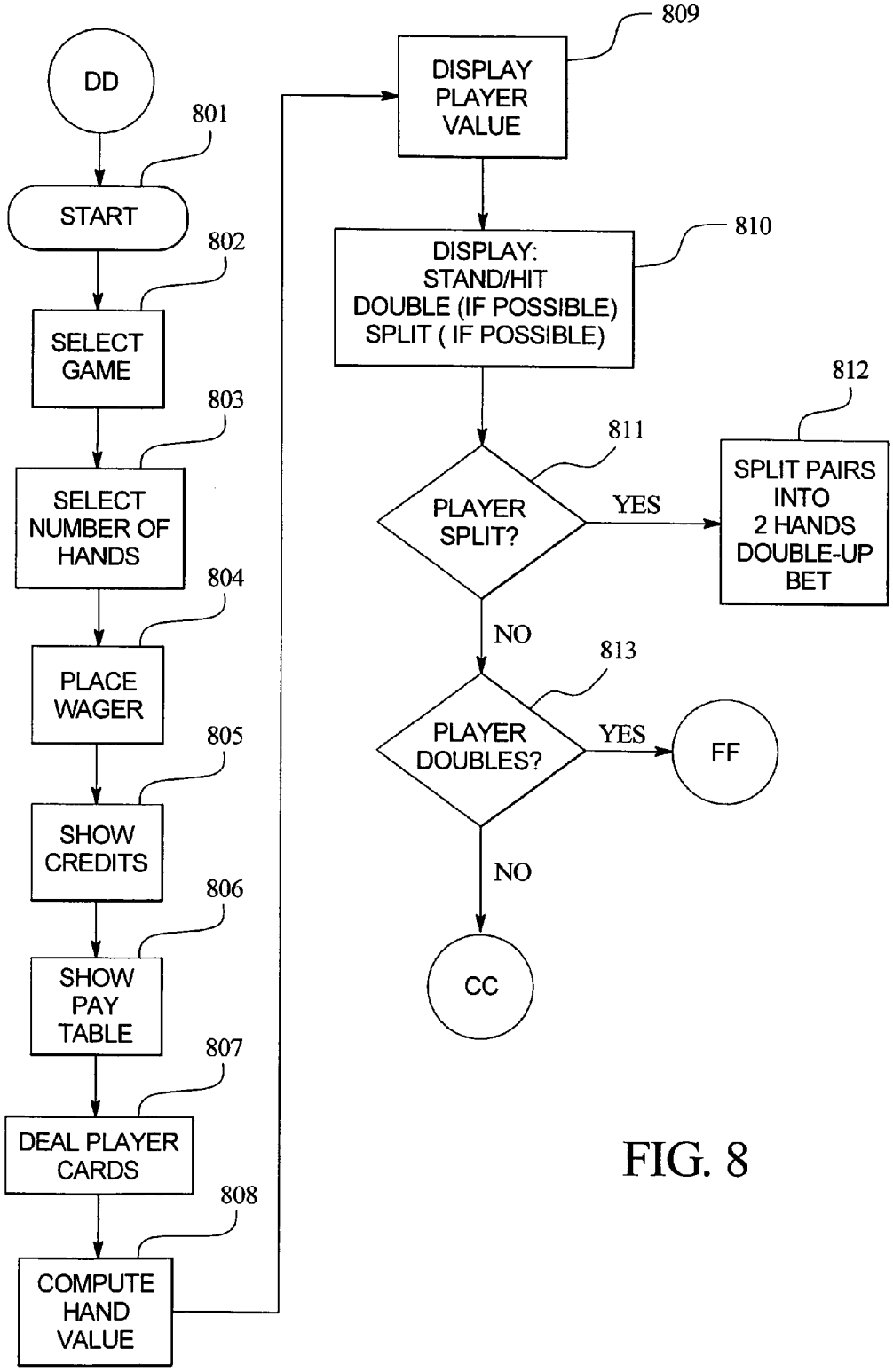
FIG. 8 is a flow diagram of the operation of the preferred embodiment.

A flow diagram illustrating the operation of the preferred embodiment is shown in FIGS. 8–11. Turning to FIG. 8, after start 801, the game is selected 802, the number of hands to be played by the player is selected 803 and the wager per hand played is placed 804. The wagered amount can be equal for each hand (as in the preferred embodiment) or different for each hand—so long as the amount wagered for each hand exceeds any minimum amount and is below any maximum wager level set by the house rules. The remaining credits, which can be the money left as the player's credit balance, is shown 805. The pay table is shown 806. The initial dealer and player cards are dealt 807 and the two-card value of each player hand is computed 808. The two-card value of each player hand is displayed 809 and the stand/hit 21 and 22 double buttons (if doubling is allowed for that situation under house rules) 23 and split button 65 (if splitting is allowed for that situation under house rules) are shown 810. If pairs of the same value cards are dealt in any of the player hands 811, the split sign 65 appears and the player can choose to "split" the pairs 812. If they are split 812, the bet is doubled.

Figure 9:
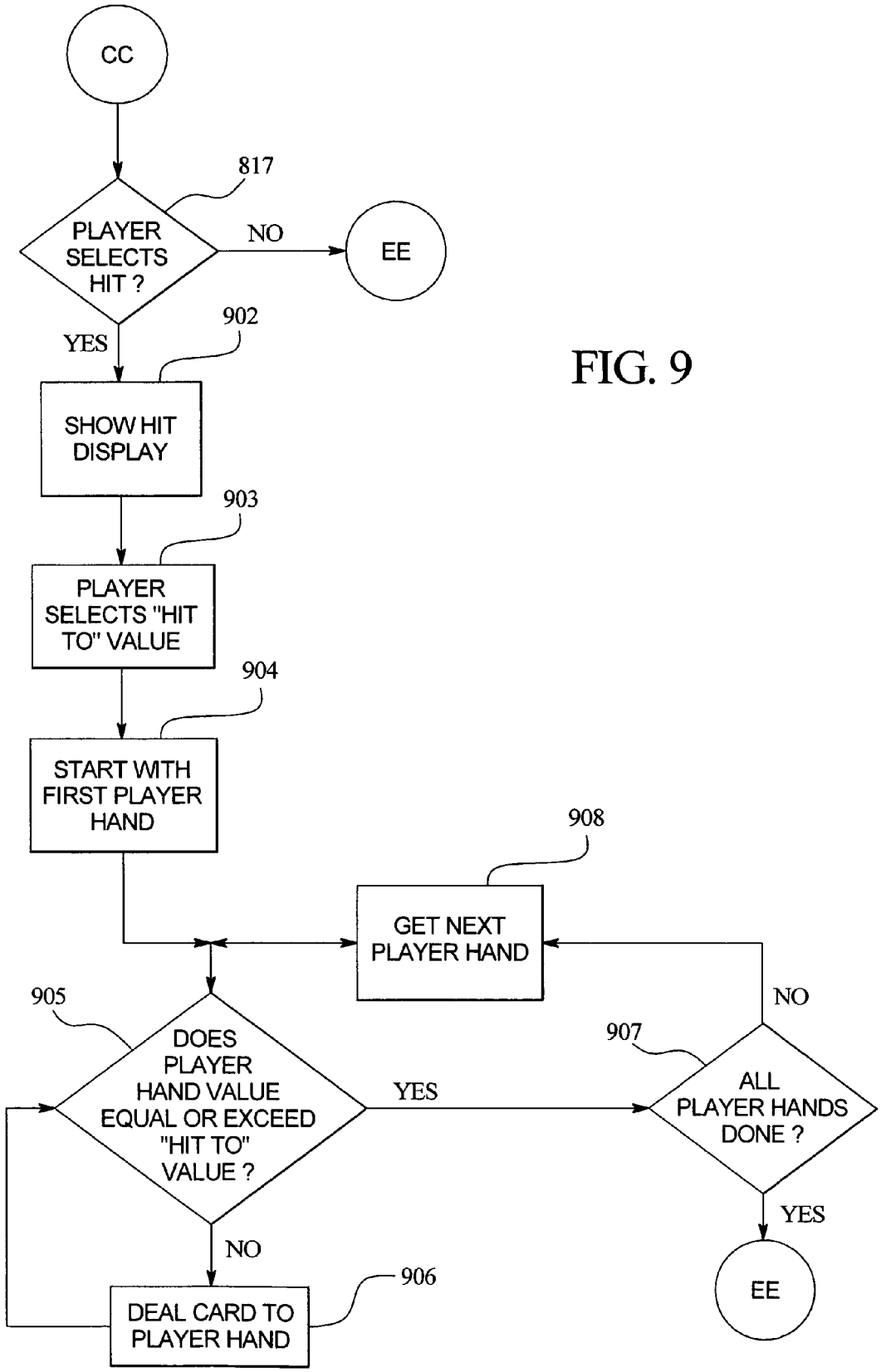
FIG. 9 is another flow diagram of the operation of the preferred embodiment.

Continuing with FIG. 8, if pairs are not dealt or if the player decides not to split the pairs, the player chooses whether to "double" 813 or "hit" 817 (as shown in FIG. 9). Likewise, at this time, the player decides whether to take "insurance" or "surrender" based upon conventional play of "21" and the controlling house rules.

Turning to FIG. 9, player selects whether to hit 817. If so, the hit display is shown 902. The player selects the "hit to" or stand value 903. The player starts with the first player hand 904. The computer must determine whether the hand value equals or exceeds the "hit to" or stand value 905. If not, a card is dealt to the player hand 906. If so, and if all the player hands are not done 907, then the process is repeated for the next player hand 908. Each of the player's hands is "hit" until it equals or surpasses the "Hit To" amounts 905 or "bust". If all of the player's hands are done 907, the dealer cards are then revealed. Thereafter, the dealer's cards are revealed 1001 and play continues as described above with respect to FIG. 10.

Figure 10:
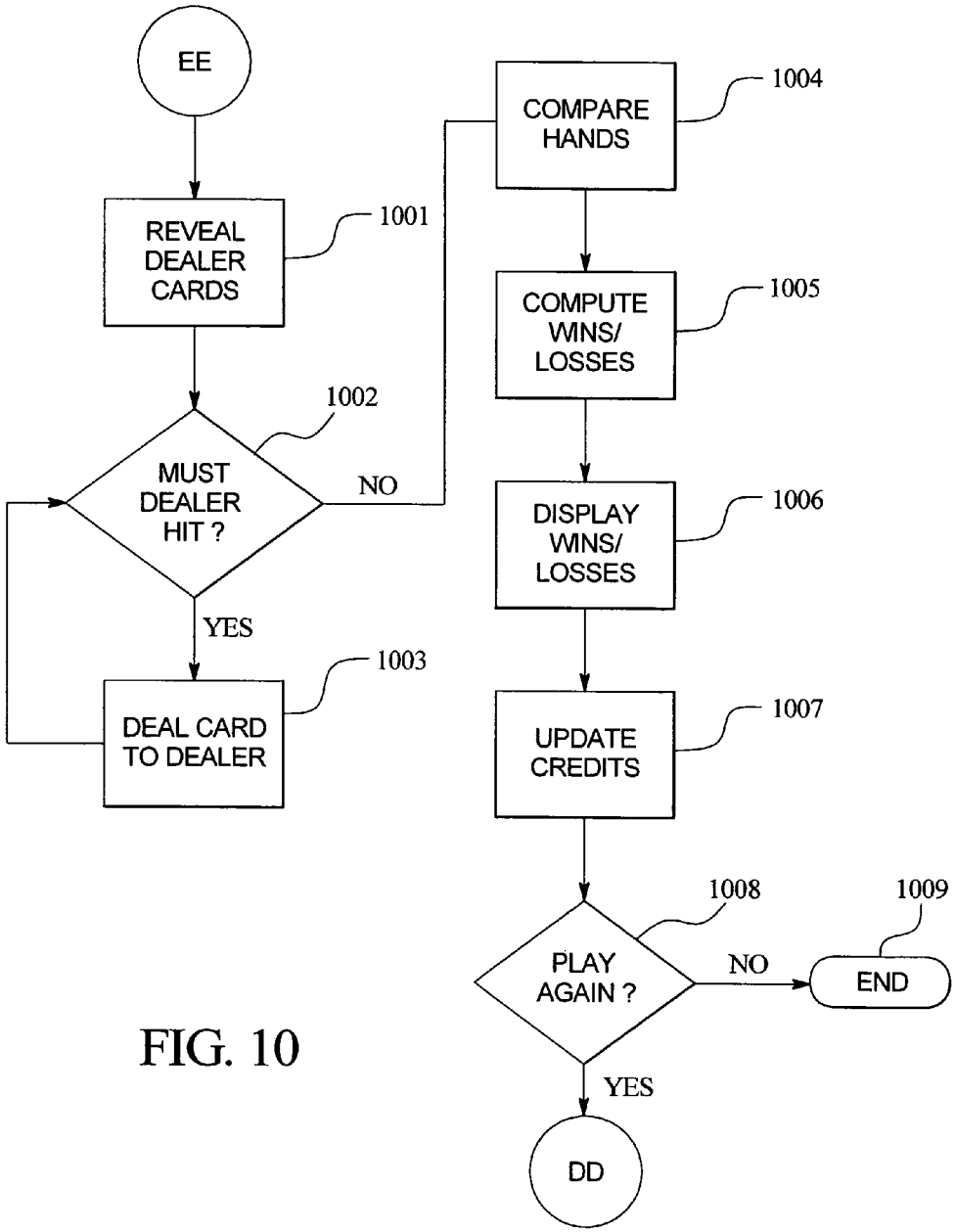
FIG. 10 is another flow diagram of the operation of the preferred embodiment.
Figure 11:
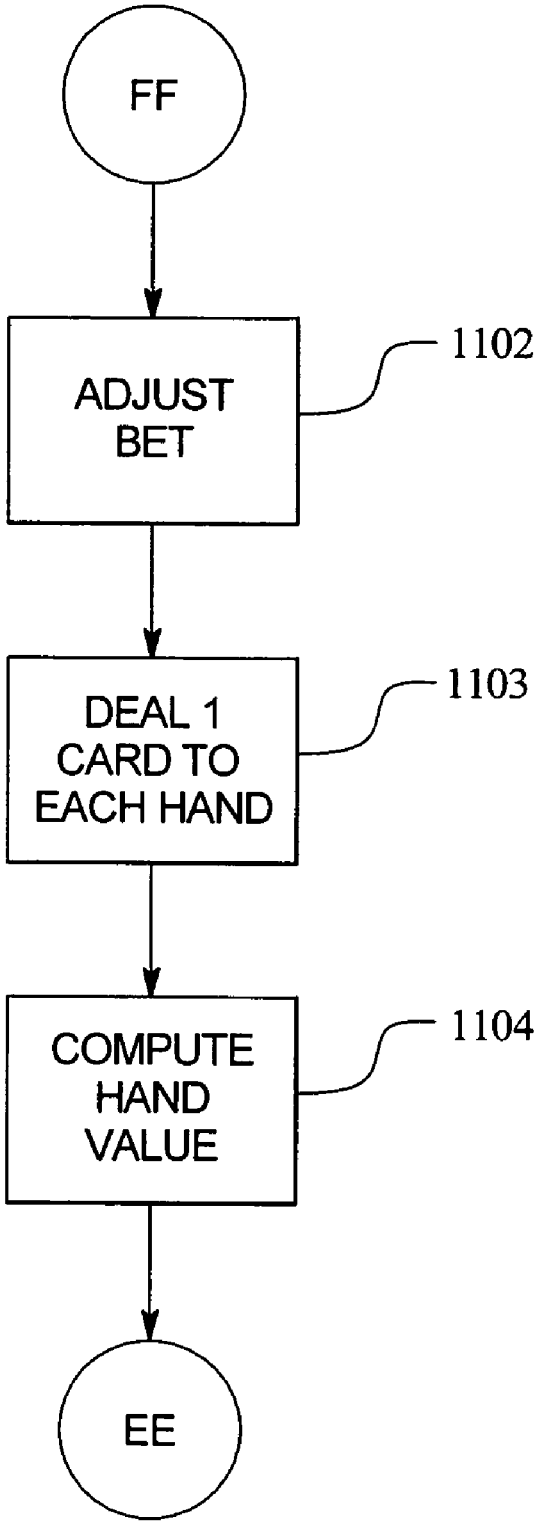
FIG. 11 is another flow diagram of the operation of the preferred embodiment.

With respect to FIG. 8, if player decides to double 813, as shown in FIG. 11, the bet is adjusted 1102, one card is dealt to each hand 1103 and the hand value is computed 1104. Play then continues by revealing the dealer's cards 1001 as described for FIG. 10.

Turning to FIG. 10, if the player chooses to "stand" the dealer cards are revealed 1001, if the numerical value of the dealer's hand is such that the dealer must "hit" 1002 under house rules, then the dealer is dealt cards 1003 until the level is reached where either the dealer no longer must "hit" or "ousts". Once the dealer must no longer "hit" or "busts", the dealer and player hands are compared 1004, the wins or losses are computed 1005, the wins or losses are displayed 1006, and the remaining credits are updated 1007. If the player desires to play again 1008, the process can start 801 as shown in FIG. 8. If the player no longer wishes to play, the game is ended 1009 as shown in FIG. 10.

Where the player's hands start out with a different set of two initial cards per hand, an automated process of decision-making where the multiple player hands are formed from different initial two cards is described as follows. The single insurance decision can be duplicated across all hands, since it is a bet on the dealer's down card, and does not involve the player's hand. If it is possible for the player to split any of his multiple hands, the player chooses to split, and then a ranking of split hands is displayed. Similar to the "hit" selection previously described, the player with a single decision, decides to split all paired hands at or above a certain ranking, and not split those hands below that ranking. The player would base this decision on his interpretation of the strength of the dealer's up card 28, as shown in FIG. 1A, for example. In this way a near optimal strategy can be achieved with a single decision. Likewise, if a player elects to double, a ranking of doubled hands is displayed (11, 10, 9, etc.) and the player with a single decision elects to double all those hands at or above a certain rank. For example, doubling all hands 10 or greater would result in the doubling of hands of value 10 and 11 respectively. Again the decision would be based upon the players interpretation of the strength of the dealer's up card.

Figure 12:
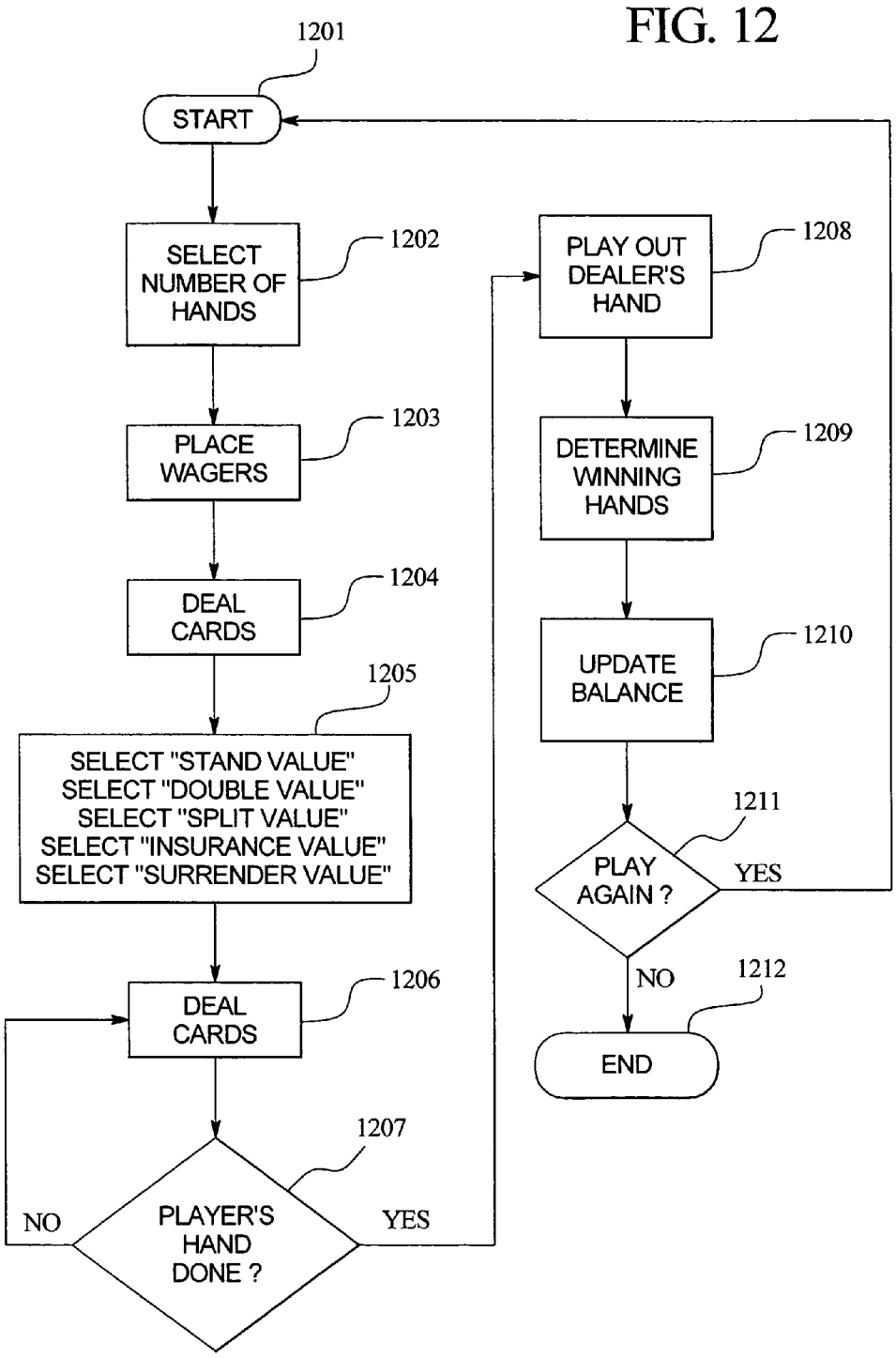
FIG. 12 is a flow diagram of the operation of another embodiment where the player pre-selects such strategy as the "stand value", "double value", "insurance value", "split value" and/or "surrender value".

FIG. 12 illustrates a version of the game where the player pre-selects such strategy as one or more of the "stand value", "double value", "insurance value", "split value" and/or "surrender value". Other versions of the game allow for the player to pre-select all or portions of the strategy, or to pre-select from multiple "auto-play" strategies that differ from each other as their degree of aggressiveness. For example, a more aggressive strategy would: use a higher "stand value"; "double" on nine, ten or eleven, as opposed to only on eleven, decline insurance in all situations, surrender all hands below 15 and/or split all pairs. In the version of FIG. 12, the game starts 1201, the wagers are placed 1203 on each of the player's hands and the cards are dealt 1204. The player can then select the "stand value", "double value", "split value", "insurance value" and "surrender value" 1205. The cards are then dealt 1206 and the pre-selected instructions as to how to play the player's hands are executed by the computer. Cards are dealt 1206 until the player's hands are done 1207 and the dealer's hands are played out 1208. The winning hands are determined 1209, the balances are updated 1210. If the player decides not to play again 1211, the game ends 1212. Otherwise, the game restarts 1201.

Figure 13:
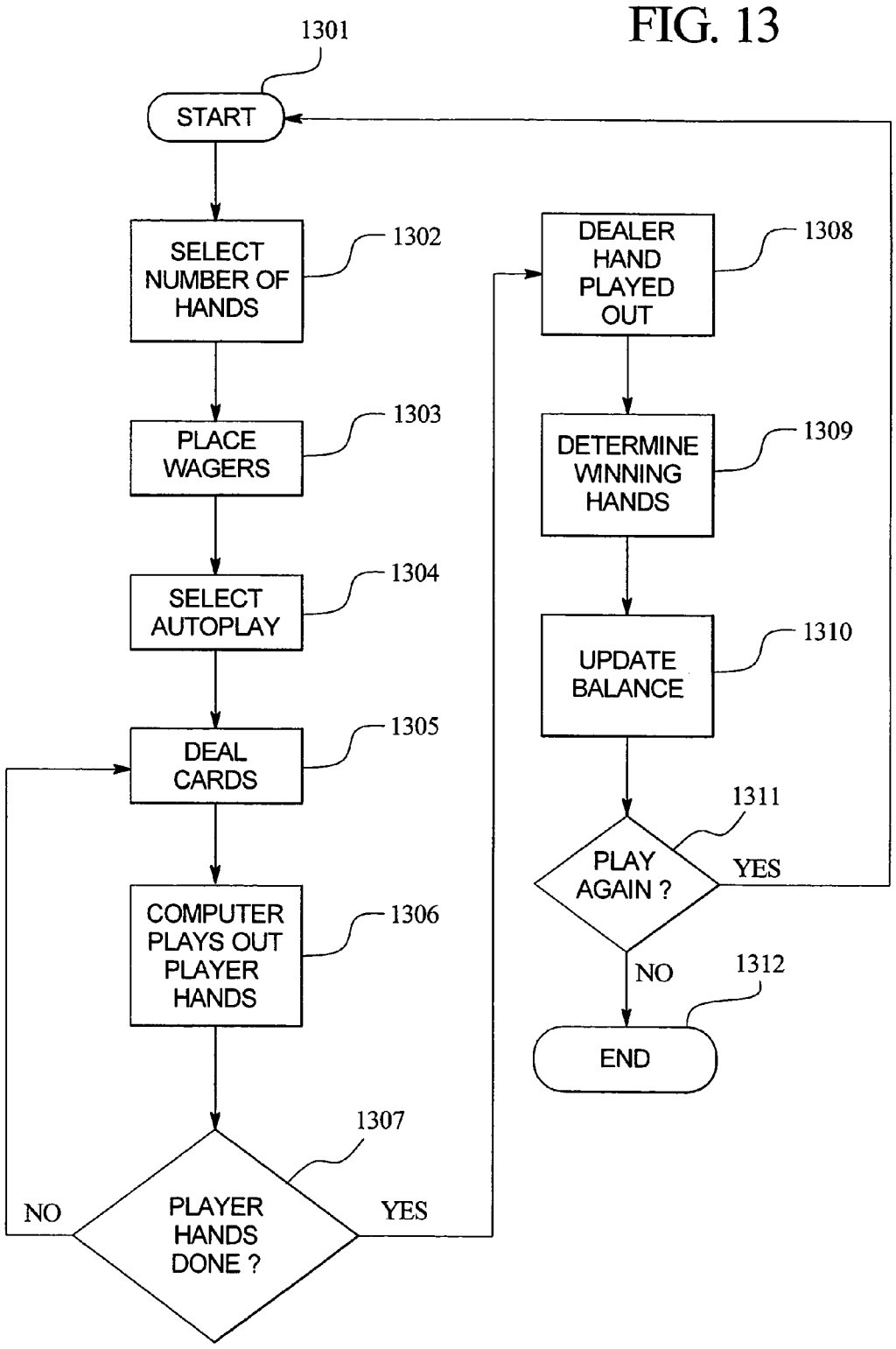
FIG. 13 is a flow diagram of the operation of another embodiment where the player has the option to "auto-play" the hand.

In the preferred embodiment, the player has an additional option to "auto-play" the hand. In this case all decisions regarding splitting, doubling, insurance, surrender, hitting, splitting and standing are automatically determined by the computer. As shown in FIG. 13, in this version, the game is started 1301, the number of hands is selected 1302, the wagers are placed on each player hand 1303, and "auto-play" is selected 1304 by the player. The cards are then dealt 1305 and the computer plays out the player's hands 1306, pursuant to a preprogrammed set of rules and strategy as to when to "hit", "double", "split" and/or "surrender". If the player's hands are done 1307, then the dealer's hand is played out according to house rules. If not, then additional cards are dealt to the player's hands 1305. Once the dealer's cards and hands are played out, the winning hands are determined 1309, balances are updated 1310. If the player decides to play again 1311, the game starts again 1301. If not, the game ends 1312.

In another embodiment, the player can play against multiple dealer hands. In effect, all of a player's multiple hands would play a separate game against each of the dealer's multiple hands. One way to handle the betting in such a multiple player hand/multiple dealer hand scenario is to require a separate, equal bet for each player hand being played against each dealer hand. For example, if a player is playing two hands against two dealer hands, he or she must place two equal bets on each of his or her player hands (one bet for each dealer hand being played). Hence, if one of the player's hands beat both of the dealer's hands (the player would be up two bets as to that player hand) and the other player hand won against one of the dealer hands and lost against the other (the player would be up 0 as to that player hand) the net result would be that the player would go up 2 bets. If the dealer were playing more than two hands, then the player would have to multiply his or her bet by the number of dealer hands in order to play against such multiple dealer hands. In effect, the player would be playing a separate, equal bet for each player hand against each dealer hand. The method of play of the present invention can be displayed in a single player electronic video gaming machine, computer game and/or a live table game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description but as merely providing illustrations of some of the presently preferred embodiments of the invention. The scope of the invention should be determined by the appended claims and their legal equivalents.

What is claimed is:

1. A gaming device comprising:

a card game being a modified version of Blackjack wherein a player plays a plurality of hands against at least one hand of a dealer;

a display device operable to display the card game to the player;

an input device; and a computing device operable with the display device and the input device to:

(a) deal a plurality of cards to each of the player's hands, each of the cards in the player's hands having a value;

(b) deal a plurality of cards to the dealer's hand, one of the cards being dealt face up, each of the cards in the dealer's hand having a value;

(c) determine a point value for each of the player's hands, the point value for each of the player's hands being based on the values of the cards in said player's hand;

(d) enable the player to input a single point value applicable to all of the player's hands, wherein said inputted single point value is used to determine if the point value of each of the player's hands satisfies a predefined relation to said inputted single point value;

(e) deal one or more additional cards to each of the player's hands until the point value for each of the player's hands satisfies the predefined relation;

(f) determine a point value for the dealer's hand, said point value being based on the values of the cards in the dealer's hand;

(g) deal one or more additional cards to the dealer's hand unless or until the point value of the dealer's hand satisfies predefined criteria; and (h) determine which of the player's hands are winning hands.

2. The gaming device of claim 1, wherein the predefined relation includes a condition of being equal to or greater than the inputted single point value.

3. The gaming device of claim 1, wherein the predefined relation includes a condition of being equal to the inputted single point value.

4. The gaming device of claim 1, wherein the predefined relation includes a condition of being greater than the inputted single point value.

5. The gaming device of claim 1, wherein, for each of the player's hands, the point value determined for said player's hand includes a sum of the values in said player's hand.

6. The gaming device of claim 5, wherein the display device includes at least one image displaying, for each of the player's hands, the sum of the values in said player's hand.

7. The gaming device of claim 5, wherein the card game includes at least one Blackjack rule.

8. The gaming device of claim 7, wherein the Blackjack rule includes a rule that permits one of the player's hand to be a winning hand only if the point value of the player's hand is less than or equal to twenty-one.

9. The gaming device of claim 7, which includes a plurality of credits associated with the winning hand, the credits being awardable to the player.

10. The gaming device of claim 7, wherein the computing device includes a computer instruction executable to enable the player to input a decision according to the Blackjack rule.

11. The gaming device of claim 10, wherein the decision includes a decision selected from the group consisting of a decision to double down, a decision to split a pair, a decision to take insurance and a decision to surrender.

12. The gaming device of claim 11, wherein the computing device includes a computer instruction executable to automatically apply the decision to each of the player's hands.

13. The gaming device of claim 1, wherein the point value of the dealer's hand includes a sum of the values in the dealer's hand.

14. The gaming device of claim 13, wherein the predefined criteria includes criteria selected from the group consisting of criteria that causes the dealer's hand to be dealt additional cards until the point value of the dealer's hand is equal to or greater than seventeen, criteria that causes the dealer's hand to be dealt additional cards until the point value of the dealer's hand is equal to or greater than sixteen, and criteria that causes the dealer's hand to be dealt an additional card if the point value of the dealer's hand is a "soft" sixteen or less.

15. The gaming device of claim 1, wherein the computing device includes a computer instruction executable to cause at least one of the cards dealt to one of the player's hands to be different from at least one of the cards dealt to another one of the player's hands.

16. The gaming device of claim 1, wherein the computing device includes a computer instruction executable to cause the cards dealt to the player's hands to be identical for each of said player's hands.

17. The gaming device of claim 1, wherein the computing device includes a computer instruction executable to cause a plurality of the cards to be dealt from a plurality of sets of one or more decks of playing cards that may or may not be identical.

18. The gaming device of claim 1, wherein the computing device includes a computer instruction executable to enable the player to select a quantity of hands to play against the dealer's hand.

19. The gaming device of claim 1, wherein the computing device includes a computer instruction executable to enable the player to select a wager to be placed on at least one of the player's hands.

20. The gaming device of claim 19, wherein the computing device includes a computer instruction executable to cause each of the player's hands to have an identical wager.

21. The gaming device of claim 1, wherein the card game includes a plurality of hands for the dealer.

22. A method for operating a gaming device having a card game being a modified version of Blackjack wherein a player plays a plurality of hands against at least one hand of a dealer, the method comprising:

(a) providing a plurality of cards having values;

(b) dealing a plurality of the cards to each of the player's hands;

(c) dealing a plurality of the cards to the dealer's hand so that one of the cards is dealt face up;

(d) determining a point value for each of the player's hands, the point value for each of the player's hands based on the values of the cards in said player's hand;

(e) enabling the player to input a single point value applicable to all of the player's hands, wherein said inputted point value is used to determine when the point value of each of the player's hands satisfies a predefined relation to said single point value;

(f) dealing one or more additional cards to each of the player's hands until the point value for each of the player's hands satisfies the predefined relation;

(g) determining a point value for the dealer's hand based on the values of the cards in the dealer's hand;

(h) dealing one or more additional cards to the dealer's hand unless or until the point value of the dealer's hand satisfies predefined criteria; and (i) determining which of the player's hands are winning hands.

23. The method of claim 22, wherein dealing one or more additional cards to each of the player's hands until the point value for each of the player's hands satisfies the predefined relation includes dealing one or more additional cards to each of the player's hands until the point value for each of the player's hands is equal to or greater than the inputted single point value.

24. The method of claim 22, wherein dealing one or more additional cards to each of the player's hands until the point value for each of the player's hands satisfies the predefined relation includes dealing one or more additional cards to each of the player's hands until the point value for each of the player's hands is equal to the inputted single point value.

25. The method of claim 22, wherein dealing one or more additional cards to each of the player's hands until the point value for each of the player's hands satisfies the predefined relation includes dealing one or more additional cards to each of the player's hands until the point value for each of the player's hands is greater than the inputted single point value.

26. The method of claim 22, wherein determining a point value for each of the player's hands includes determining, for each of the player's hands, a sum of the values in said player's hand.

27. The method of claim 26 which includes displaying, for each of the player's hands, the sum of the values in said player's hand.

28. The method of claim 26, which includes providing at least one Blackjack rule for the card game.

29. The method of claim 28, which includes permitting one of the player's hands to be a winning hand only if the point value of said player's hand is less than or equal to twenty-one.

30. The method of claim 28, which includes enabling the player to input a decision according to the Blackjack rule.

31. The method of claim 30, wherein enabling the player to input a decision according to the Blackjack rule includes enabling the player to input a decision selected from the group consisting of a decision to double down, a decision to split a pair, a decision to take insurance and a decision to surrender.

32. The method of claim 31, which includes automatically applying the decision to each of the player's hands.

33. The method of claim 22, wherein determining a point value for the dealer's hand includes determining a sum of the values in the dealer's hand.

34. The method of claim 33, wherein dealing one or more additional cards to the dealer's hand unless or until the point value of the dealer's hand satisfies predefined criteria includes dealing one or more additional cards to the dealer's hand unless or until the point value of the dealer's hand satisfies predefined criteria selected from the group consisting of criteria that causes the dealer's hand to be dealt additional cards until the point value of the dealer's hand is equal to or greater than seventeen, criteria that causes the dealer's hand to be dealt additional cards until the point value of the dealer's hand is equal to or greater than sixteen, and criteria that causes the dealer's hand to be dealt an additional card if the point value of the dealer's hand is a "soft" sixteen or less.

35. The method of claim 22, which includes providing a plurality of credits associated with the winning hand, the credits being awardable to the player.

36. The method of claim 22, which includes causing at least one of the cards dealt to one of the player's hands to be different from at least one of the cards dealt to another one of the player's hands.

37. The method of claim 22, which includes causing the cards dealt to the player's hands to be identical for each of said player's hands.

38. The method of claim 22, which includes dealing a plurality of cards to each of the player's hands from a plurality of sets of one or more decks of playing cards that may or may not be identical.

39. The method of claim 22, which includes enabling the player to select a quantity of hands to play against the dealer's hand.

40. The method of claim 22, which includes enabling the player to select a wager to be placed on at least one of the player's hands.

41. The method of claim 40, which includes causing each of the player's hands to have an identical wager.

42. The method of claim 22, which includes providing a plurality of hands for the dealer.

43. A gaming device comprising:

a card game based on Blackjack wherein a player plays a plurality of hands against at least one hand of a dealer;

a display device operable to display the card game to the player;

an input device;

a computing device operable with the display device and input device to:

(a) deal a plurality of cards to each of the player's hands, each of the cards in the player's hands having a value;

(b) deal a plurality of cards to the dealer's hand, one of the cards being dealt face up, each of the cards in the dealer's hand having a value;

(c) sum the values of the cards for each of the player's hands to determine a point value for each of the player's hands;

(d) enable the player to input a single point value applicable to all of the player's hands, wherein said inputted point value is used to determine if the point value of each of the player's hands meets or exceeds said inputted point value;

(e) deal one or more additional cards to each of the player's hands unless or until the point value for each of the player's hands is equal to or greater than the inputted single point value;

(f) sum the values of the cards in the dealer's hand to determine a point value for the dealer's hand;

(g) deal one or more additional cards to the dealer's hand unless or until the point value of the dealer's hand satisfies predefined criteria; and (h) determine which of the player's hands are winning hands.

44. The gaming device of claim 43, wherein the predefined criteria includes criteria selected from the group consisting of criteria that causes the dealer's hand to be dealt additional cards until the point value of the dealer's hand is equal to or greater than seventeen, criteria that causes the dealer's hand to be dealt additional cards until the point value of the dealer's hand is equal to or greater than sixteen, and criteria that causes the dealer's hand to be dealt an additional card if the point value of the dealer's hand is a "soft" sixteen or less.

45. The gaming device of claim 43, wherein the computing device includes a computer instruction executable to enable the player to input a decision according to at least one Blackjack rule, the decision selected from the group consisting of a decision to double down, a decision to split a pair, a decision to take insurance and a decision to surrender.

46. The gaming device of claim 45, wherein the computing device includes a computer instruction executable to automatically apply the decision to each of the player's hands.

47. The gaming device of claim 43, wherein the display device includes at least one image displaying, for each of the player's hands, the point value of said player's hand.

48. A method for operating a gaming device having a card game based on Blackjack wherein a player plays a plurality of hands against at least one hand of a dealer, the method comprising:

(a) providing a plurality of cards that have values;

(b) dealing a plurality of the cards to each of the player's hands;

(c) dealing a plurality of the cards to the dealer's hand so that one of the cards is dealt face up;

(d) summing the values of the cards for each of the player's hands to determine a point value for each of the player's hands;

(e) enabling the player to input a single point value applicable to all of the player's hands, wherein said inputted point value is used to determine if the point value of each of the player's hands meets or exceeds said inputted point value;

(f) dealing one or more additional cards to each of the player's hands unless or until the point value for each of the player's hands is equal to or greater than the inputted single point value;

(g) summing the values of the cards in the dealer's hand to determine a point value for the dealer's hand;

(h) dealing one or more additional cards to the dealer's hand unless or until the point value of the dealer's hand satisfies predefined criteria; and (i) determining which of the player's hands are winning hands.

49. The method of claim 48, wherein dealing one or more additional cards to the dealer's hand unless or until the point value of the dealer's hand satisfies predefined criteria includes dealing one or more additional cards to the dealer's hand unless or until the point value of the dealer's hand satisfies predefined criteria selected from the group consisting of criteria that causes the dealer's hand to be dealt additional cards until the point value of the dealer's hand is equal to or greater than seventeen, criteria that causes the dealer's hand to be dealt additional cards until the point value of the dealer's hand is equal to or greater than sixteen, and criteria that causes the dealer's hand to be dealt an additional card if the point value of the dealer's hand is a "soft" sixteen or less.

50. The method of claim 48, which includes enabling the player to input a decision according to at least one Blackjack rule, the decision selected from the group consisting of a decision to double down, a decision to split a pair, a decision to take insurance and a decision to surrender.

51. The method of claim 50, which includes the step automatically applying the decision to each of the player's hands.

52. The method of claim 48 which includes displaying, for each of the player's hands, the point value of said player's hand.

53. A gaming device comprising:

a card game based on Blackjack wherein a player plays a plurality of hands against at least one hand of a dealer;

a display device operable to display the card game to the player;

an input device;

a computing device operable with the display device and input device to:

(a) deal a plurality of cards to each of the player's hands, each of the cards in the player's hands having a value;

(b) deal a plurality of cards to the dealer's hand, one of the cards being dealt face up, each of the cards in the dealer's hand having a value;

(c) sum the values of the cards for each of the player's hands to determine a point value for each of the player's hands;

(d) enable the player to input a single point value applicable to all of the player's hands, wherein said inputted single point value is used to determine if the point value of each of the player's hands exceeds said inputted single point value;

(e) deal one or more additional cards to each of the player's hands unless or until the point value for each of the player's hands is greater than the inputted single point value;

(f) sum the values of the cards in the dealer's hand to determine a point value for the dealer's hand;

(g) deal one or more additional cards to the dealer's hand unless or until the point value of the dealer's hand satisfies predefined criteria; and (h) determine which of the player's hands are winning hands.

54. The gaming device of claim 53, wherein the predefined criteria includes criteria selected from the group consisting of criteria that causes the dealer's hand to be dealt additional cards until the point value of the dealer's hand is equal to or greater than seventeen, criteria that causes the dealer's hand to be dealt additional cards until the point value of the dealer's hand is equal to or greater than sixteen, and criteria that causes the dealer's hand to be dealt an additional card if the point value of the dealer's hand is a "soft" sixteen or less.

55. The gaming device of claim 53, wherein the computing device includes a computer instruction executable to enable the player to input a decision according to at least one Blackjack rule, the decision selected from the group consisting of a decision to double down, a decision to split a pair, a decision to take insurance and a decision to surrender.

56. The gaming device of claim 55, wherein the computing device includes a computer instruction executable to automatically apply the decision to each of the player's hands.

57. The gaming device of claim 53, wherein the display device includes at least one image displaying, for each of the player's hands, the point value of said player's hand.

58. A method for operating a gaming device having a card game based on Blackjack wherein a player plays a plurality of hands against at least one hand of a dealer, the method comprising:

(a) providing a plurality of cards that have values;

(b) dealing a plurality of the cards to each of the player's hands;

(c) dealing a plurality of the cards to the dealer's hand so that one of the cards is dealt face up;

(d) summing the values of the cards for each of the player's hands to determine a point value for each of the player's hands;

(e) enabling the player to input a single point value applicable to all of the player's hands, wherein said inputted single point value is used to determine if the point value of each of the player's hands exceeds said inputted single point value;

(f) dealing one or more additional cards to each of the player's hands unless or until the point value for each of the player's hands is greater than the inputted single point value;

(g) summing the values of the cards in the dealer's hand to determine a point value for the dealer's hand;

(h) dealing one or more additional cards to the dealer's hand unless or until the point value of the dealer's hand satisfies predefined criteria; and (i) determining which of the player's hands are winning hands.

59. The method of claim 58, wherein dealing one or more additional cards to the dealer's hand unless or until the point value of the dealer's hand satisfies predefined criteria includes dealing one or more additional cards to the dealer's hand unless or until the point value of the dealer's hand satisfies predefined criteria selected from the group consisting of criteria that causes the dealer's hand to be dealt additional cards until the point value of the dealer's hand is equal to or greater than seventeen, criteria that causes the dealer's hand to be dealt additional cards until the point value of the dealer's hand is equal to or greater than sixteen, and criteria that causes the dealer's hand to be dealt an additional card if the point value of the dealer's hand is a "soft" sixteen or less.

60. The method of claim 58, which includes enabling the player to input a decision according to at least one Blackjack rule, the decision selected from the group consisting of a decision to double down, a decision to split a pair, a decision to take insurance and a decision to surrender.

61. The method of claim 60, which includes the step automatically applying the decision to each of the player's hands.

62. The method of claim 58, which includes displaying, for each of the player's hands, the point value for said player's hand.

* * * * *

UNITED STATES PATENT AND TRADEMARK OFFICE

CERTIFICATE OF CORRECTION

PATENT NO. : 6,969,316 B2
DATED : November 29, 2005
INVENTOR(S) : Eugene Jarvis et al.

It is certified that error appears in the above-identified patent and that said Letters Patent is hereby corrected as shown below:

Column 16,
Line 17, change "to said single" to -- to said inputted single --.

Signed and Sealed this

Twenty-third Day of May, 2006

JON W. DUDAS
*Director of the United States Patent and Trademark Office*